US011834858B2

(12) United States Patent
Lah

(10) Patent No.: US 11,834,858 B2
(45) Date of Patent: Dec. 5, 2023

(54) TENTS

(71) Applicant: JKL Corporation, Seoul (KR)

(72) Inventor: Jeh Kun Lah, Seoul (KR)

(73) Assignee: JKL Corporation, Seoul (KR)

( * ) Notice: Subject to any disclaimer, the term of this patent is extended or adjusted under 35 U.S.C. 154(b) by 200 days.

(21) Appl. No.: 17/425,704

(22) PCT Filed: Apr. 9, 2020

(86) PCT No.: PCT/KR2020/004861
§ 371 (c)(1),
(2) Date: Jul. 23, 2021

(87) PCT Pub. No.: WO2020/209649
PCT Pub. Date: Oct. 15, 2020

(65) Prior Publication Data

US 2022/0186519 A1 Jun. 16, 2022

(30) Foreign Application Priority Data

Apr. 10, 2019 (KR) ..... 10-2019-0041848
May 14, 2019 (KR) ..... 10-2019-0056210

(51) Int. Cl.
*E04H 15/40* (2006.01)
*E04H 15/54* (2006.01)
*E04H 15/32* (2006.01)

(52) U.S. Cl.
CPC ..... *E04H 15/40* (2013.01); *E04H 15/54* (2013.01); *E04H 2015/326* (2013.01)

(58) Field of Classification Search
CPC ..... E04H 15/40; E04H 15/44
See application file for complete search history.

(56) References Cited

U.S. PATENT DOCUMENTS 3,269,398 A 8/1966 Holbitz
3,834,410 A * 9/1974 Leibel ..... E04H 15/425 135/156

(Continued)

FOREIGN PATENT DOCUMENTS

CN 2506736 Y 8/2002
CN 202731406 U 2/2013

(Continued)

OTHER PUBLICATIONS

MSR H.U.B. High-Altitude Utility Base Camp Tent: https://www.msrgear.com/tents/all-season-tents/h.u.b.-high-altitude-utility-base-camp-tent/03203.html; available at least as early as Dec. 26, 2018.

(Continued)

*Primary Examiner* — Noah Chandler Hawk
(74) *Attorney, Agent, or Firm* — Kolitch Romano Dascenzo Gates LLC

(57) ABSTRACT

Tents are disclosed herein. The tent includes a tent frame that, when assembled, forms an assembled tent frame that is configured to support the tent on a support surface and define an inner space between the assembled tent frame and the support surface. The tent also includes at least one clearance pole that, when operatively coupled to the assembled tent frame, extends away from the inner space to define an outer space, and a clearance mechanism that is configured to operatively couple the at least one clearance pole to the assembled tent frame and orient the at least one clearance pole to project in an upward direction relative to the support surface. The clearance mechanism includes a connector that is configured to operatively couple the at least one clearance pole to the tent frame.

25 Claims, 14 Drawing Sheets

(56) References Cited

U.S. PATENT DOCUMENTS

| | | | | |
|---|---|---|---|---|
| 4,450,656 | A | 5/1984 | Lagendijk | |
| 4,558,713 | A | 12/1985 | Hagler et al. | |
| 4,581,860 | A | 4/1986 | Berger | |
| 5,345,962 | A | 9/1994 | Moss | |
| 6,012,505 | A | 1/2000 | Wurz et al. | |
| 6,021,796 | A | 2/2000 | Vavra | |
| 7,578,307 | B2 * | 8/2009 | Ung | E04H 15/425 52/645 |
| 7,987,864 | B1 | 8/2011 | Jackson | |
| 8,448,656 | B2 | 5/2013 | Choi | |
| 9,340,993 | B2 | 5/2016 | Cronk | |
| 9,366,054 | B2 | 6/2016 | Li | |
| 10,138,652 | B2 * | 11/2018 | Huang | E04H 15/48 |
| 10,227,792 | B2 * | 3/2019 | Choi | E04H 15/46 |
| 2003/0000563 | A1 | 1/2003 | Kuperman | |
| 2007/0095376 | A1 | 5/2007 | Rottmann | |
| 2011/0073147 | A1 | 3/2011 | Choi | |
| 2012/0318316 | A1 | 12/2012 | Choi | |
| 2015/0068571 | A1 | 3/2015 | Jin | |
| 2015/0315808 | A1 | 11/2015 | Cronk | |
| 2017/0167158 | A1 | 6/2017 | Lynch et al. | |
| 2018/0066446 | A1 | 3/2018 | Nolz | |
| 2018/0155952 | A1 | 6/2018 | Robert et al. | |
| 2019/0119943 | A1 * | 4/2019 | Shirley-Smith | B63B 35/58 |

FOREIGN PATENT DOCUMENTS

| | | | |
|---|---|---|---|
| CN | 203835032 | U | 9/2014 |
| CN | 204457051 | U | 7/2015 |
| DE | 29713966 | U1 | 10/1997 |
| DE | 202004008828 | U1 | 10/2005 |
| DE | 202007006799 | U1 | 4/2008 |
| GB | 2224759 | A | 5/1990 |
| GB | 2259927 | A | 3/1993 |
| GB | 2382358 | A | 5/2003 |
| GB | 2467465 | A | 8/2010 |
| JP | 2012127058 | A | 7/2012 |
| JP | 2014224442 | A | 12/2014 |
| JP | 3217504 | U | 7/2018 |
| KR | 200304423 | Y1 | 2/2003 |
| KR | 200359060 | Y1 | 8/2004 |
| KR | 200386358 | Y1 | 6/2005 |
| WO | WO9915747 | A1 | 4/1999 |

OTHER PUBLICATIONS

Kelty Trail Ridge Tent: https://www.youtube.com/watch?v=EPYQHTgg520, published Apr. 2, 2016.

English-language machine translation of Chinese Patent No. CN2506736Y, Aug. 21, 2002.

English-language machine translation of Chinese Utility Patent No. CN202731406U, Feb. 13, 2013.

English-language machine translation of Chinese Utility Patent No. CN203835032U, Sep. 17, 2014.

English-language machine translation of Chinese Utility Patent No. CN204457051U; Jul. 8, 2015.

English-language machine translation of German Patent No. DE202004008828U1, Oct. 13, 2005.

English-language machine translation of German Patent No. DE202007006799U1, Apr. 3, 2008.

English-language machine translation of Japanese Patent No. JP3217504U, Jul. 18, 2018.

English-language machine translation of Japanese Patent Application Publication No. JP2012127058A, Jul. 5, 2012.

English-language machine translation of Japanese Patent Application Publication No. JP2014224442A, Dec. 4, 2014.

English-language machine translation of Korean Patent Application Publication No. KR200304423Y1, Feb. 15, 2003.

English-language machine translation of Korean Patent Application Publication No. KR200359060Y1, Aug. 16, 2004.

English-language machine translation of DE29713966U1, downloaded from Espacenet Dec. 8, 2022.

English-language machine translation of KR200386358Y1 downloaded from Google Patents Dec. 8, 2022.

* cited by examiner

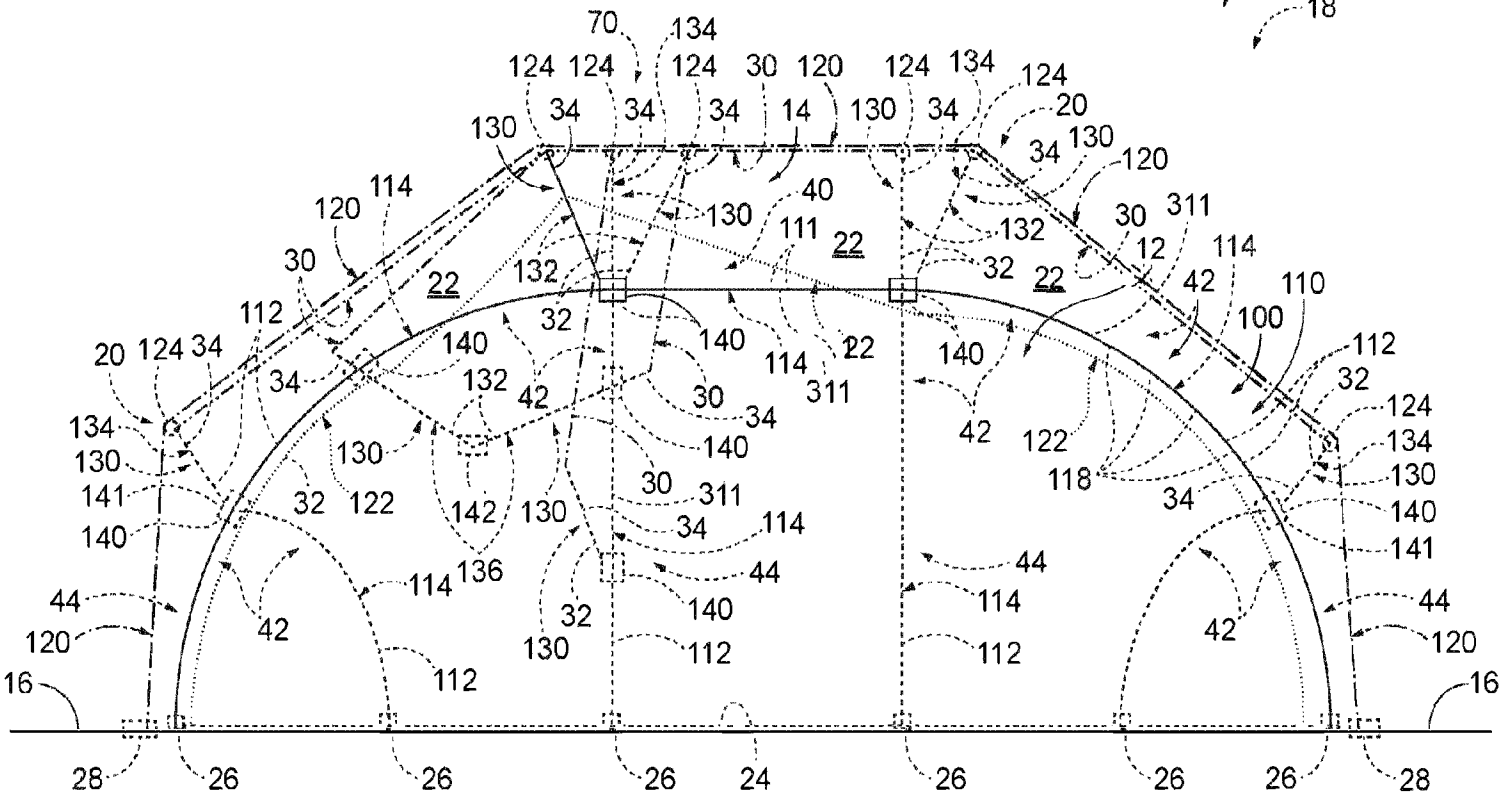
[ Fig. 1 ]

[Fig. 2]
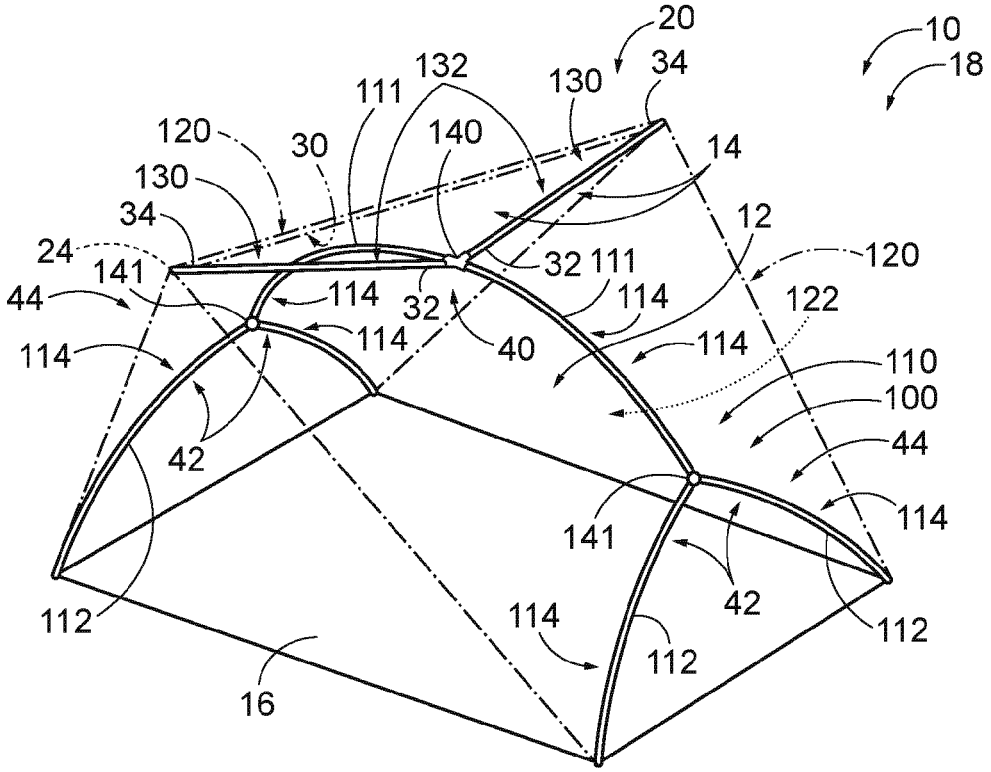
[Fig. 3]
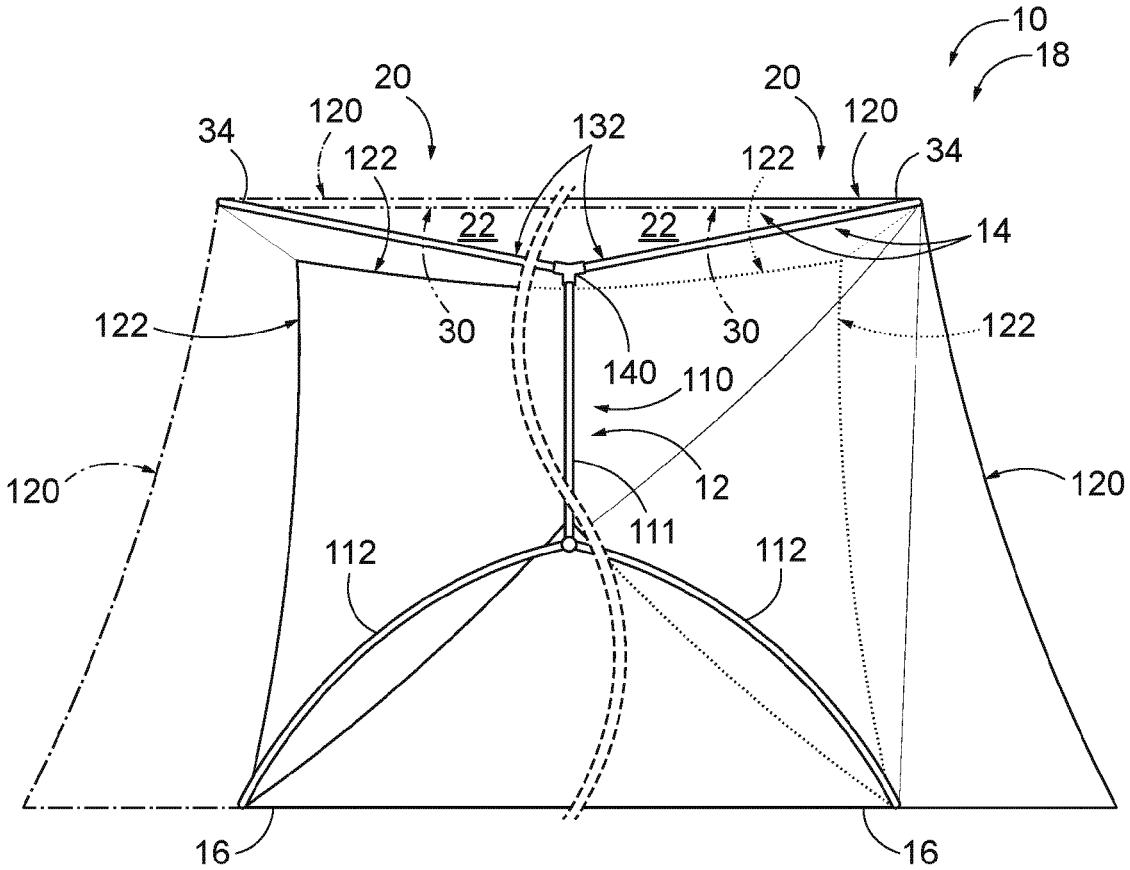

[Fig. 4]
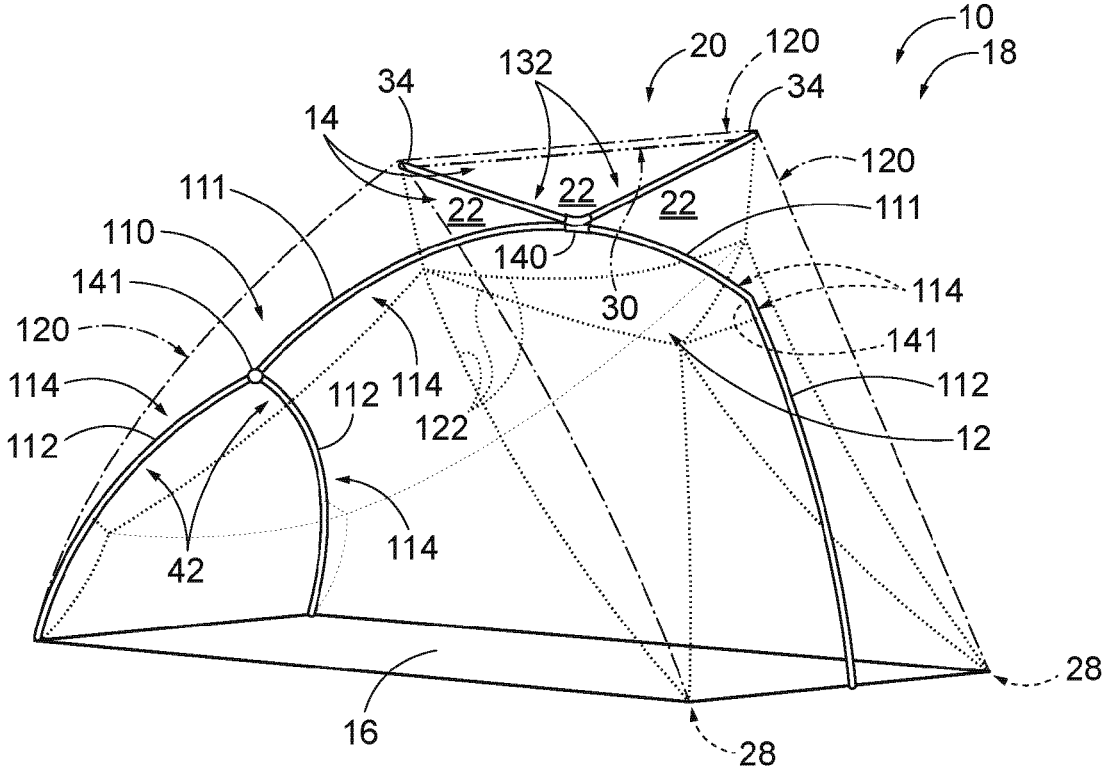
[Fig. 5]
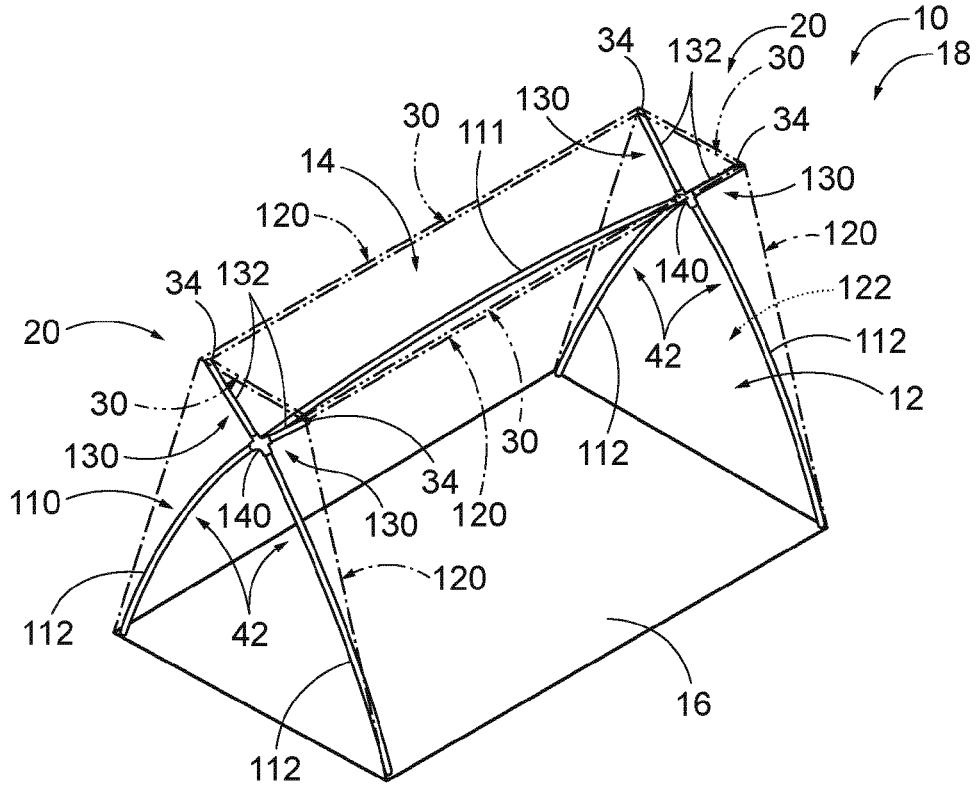

[Fig. 6]
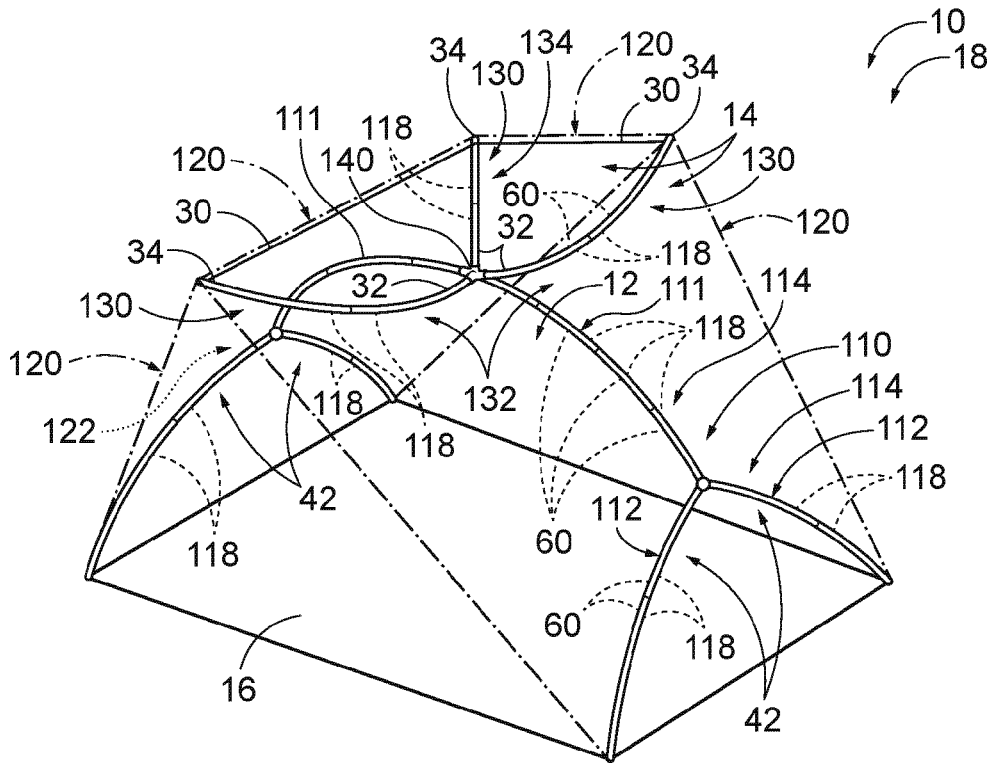
[Fig. 7]
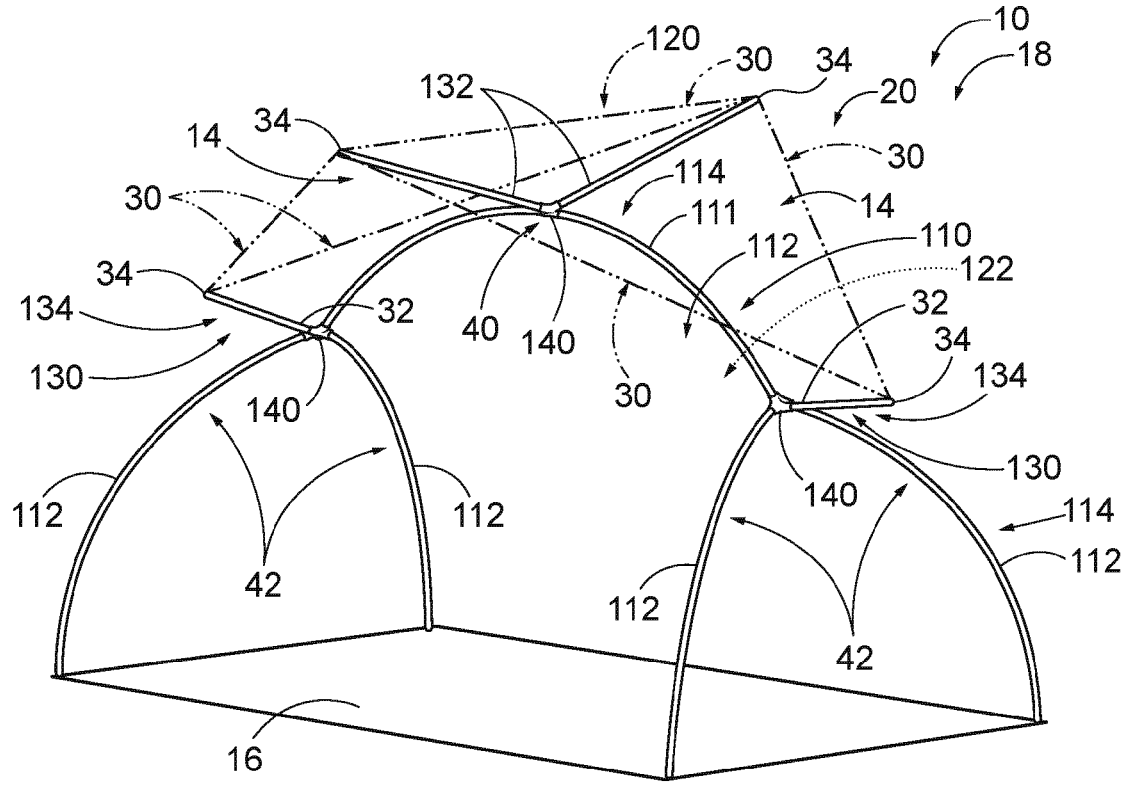

[Fig. 8]
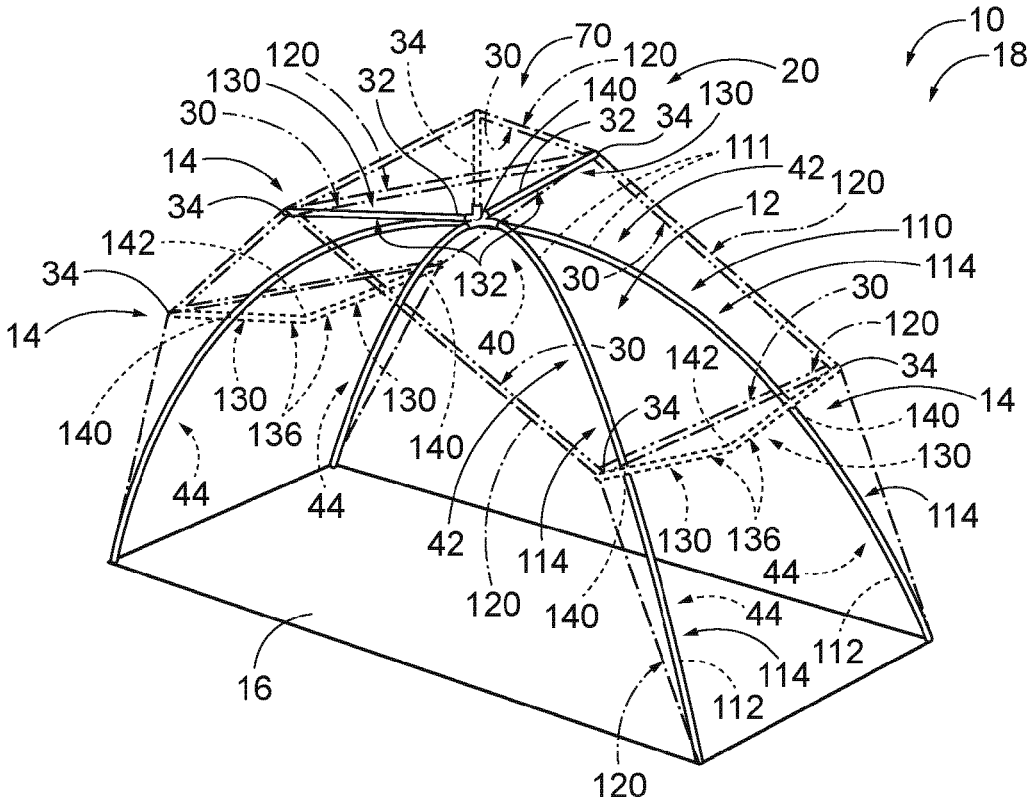
[Fig. 9]
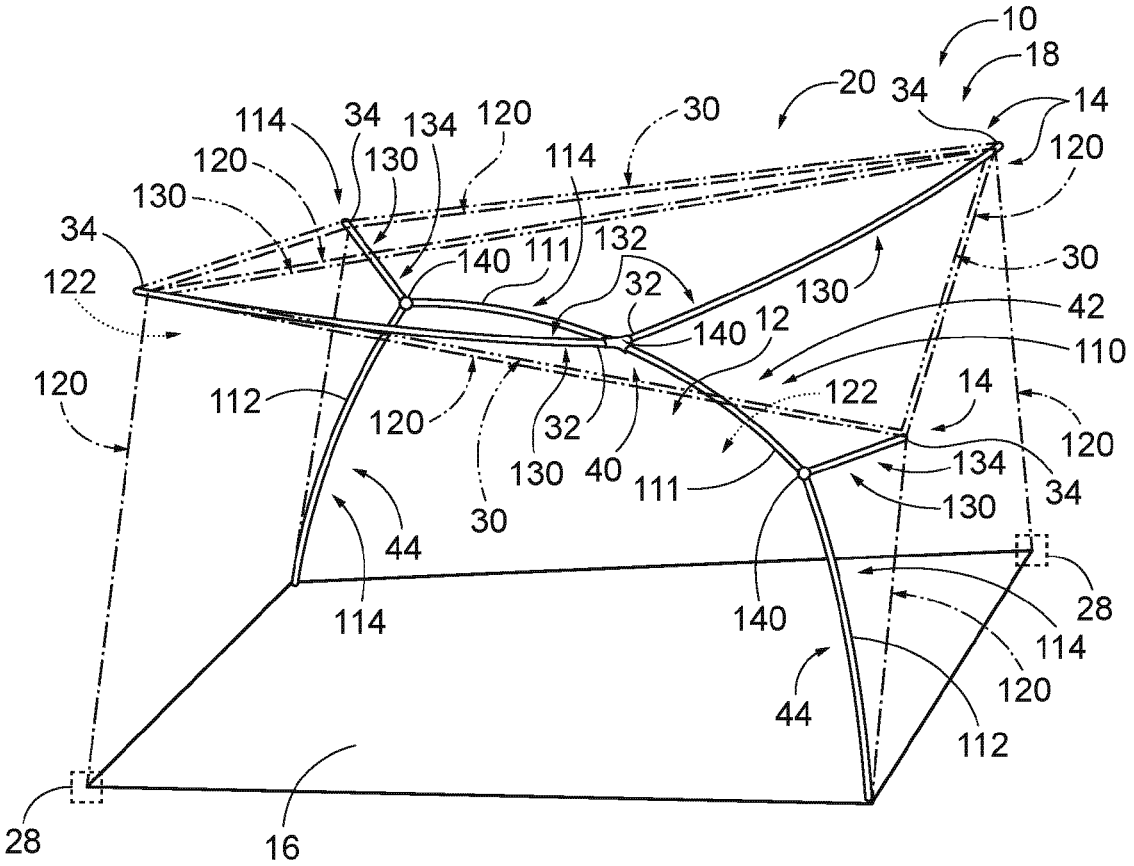

[Fig. 10]
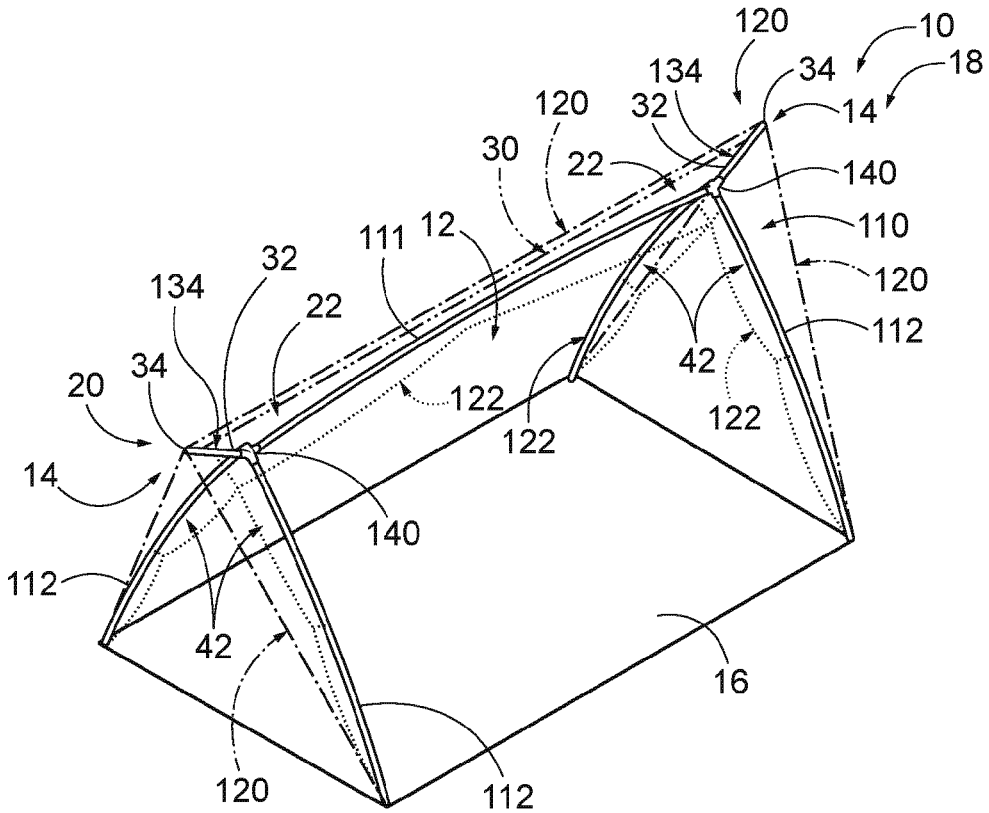
[Fig. 11]
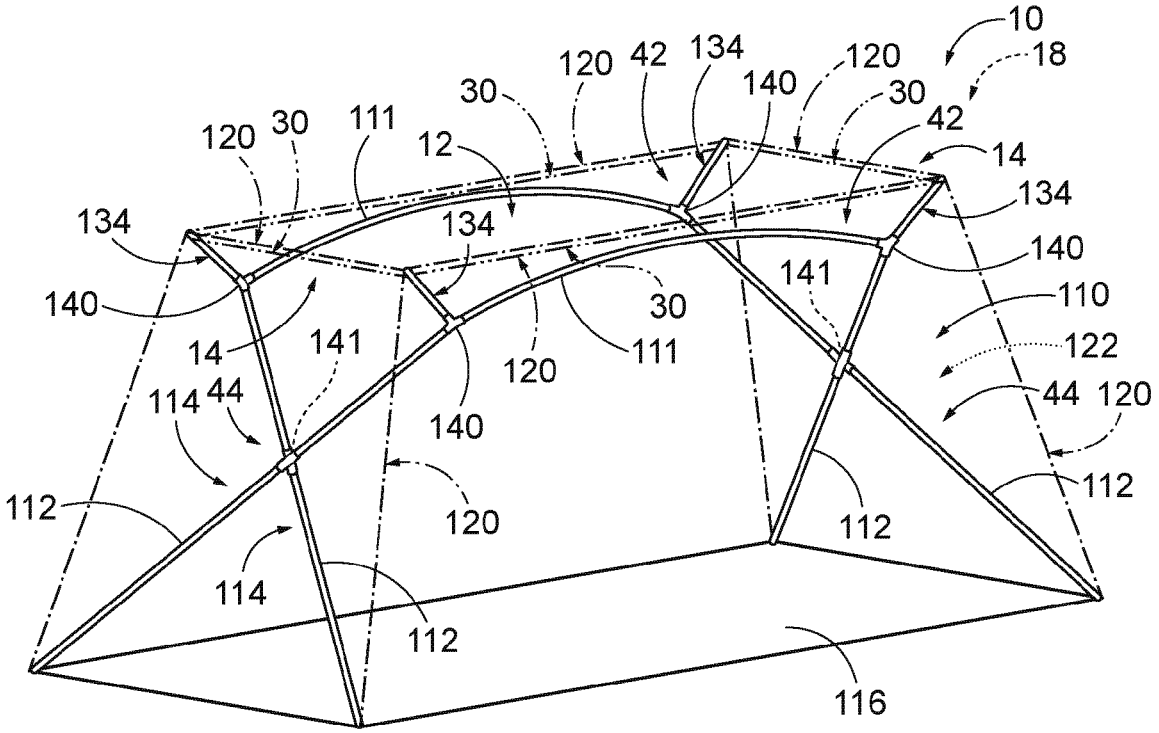

[Fig. 12]
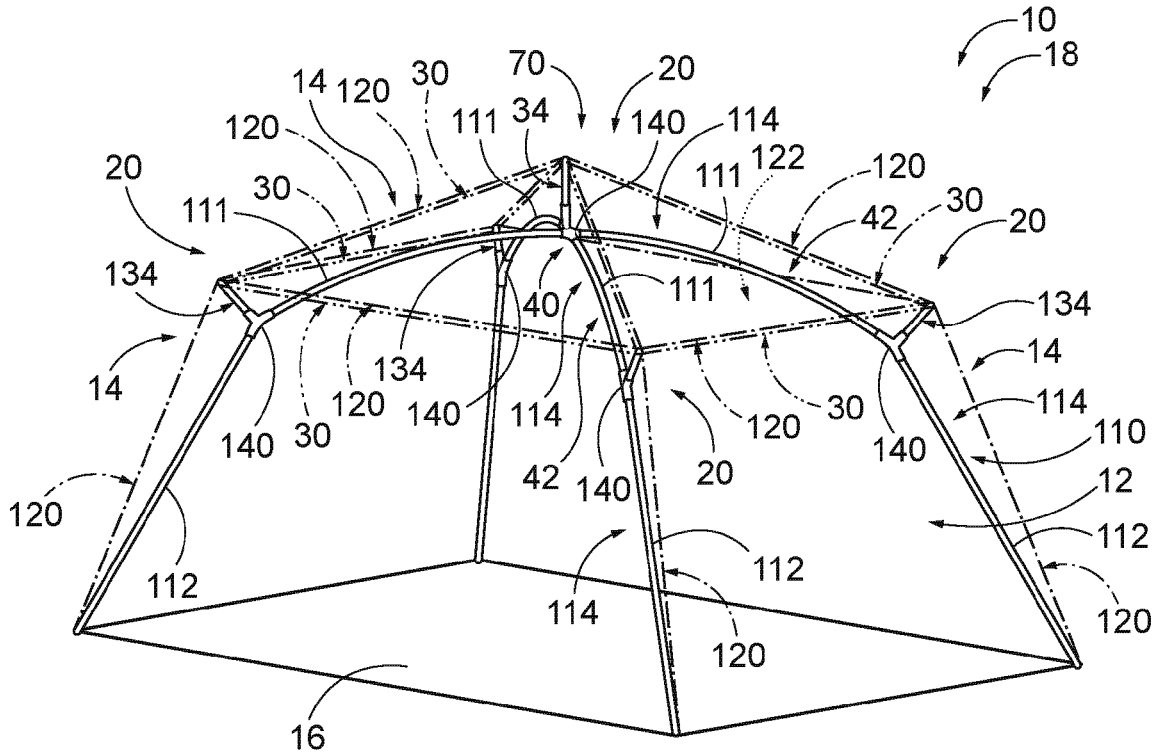
[Fig. 13]
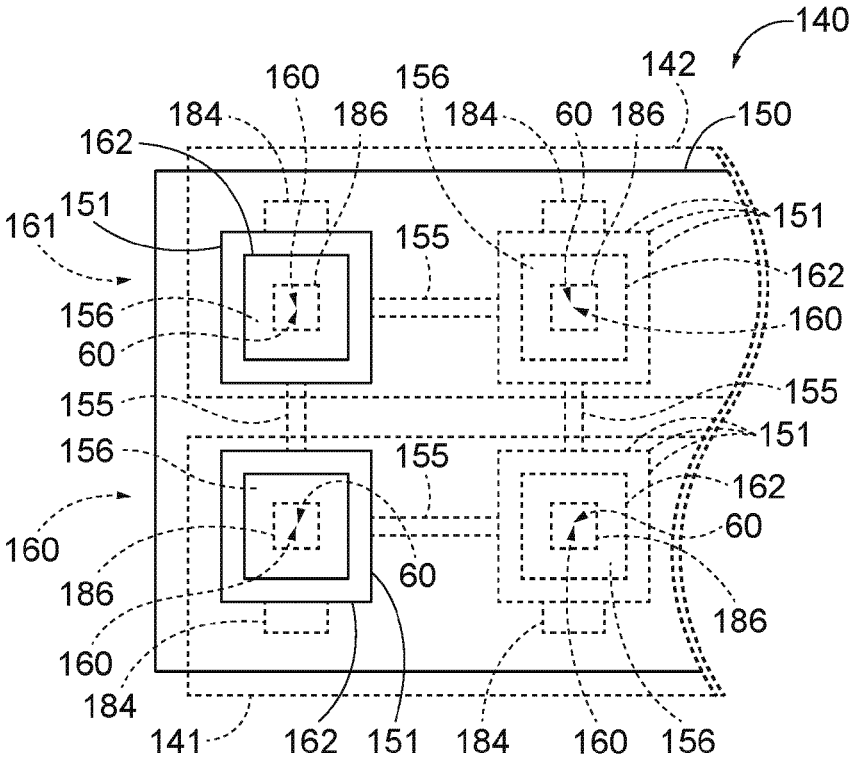

[Fig. 14]
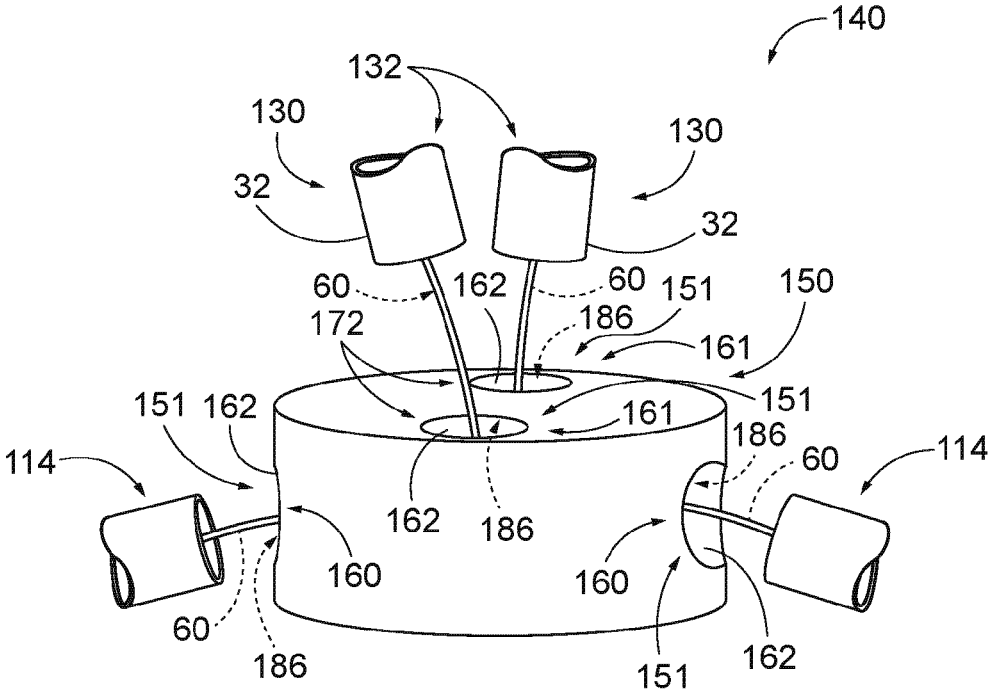
[Fig. 15]
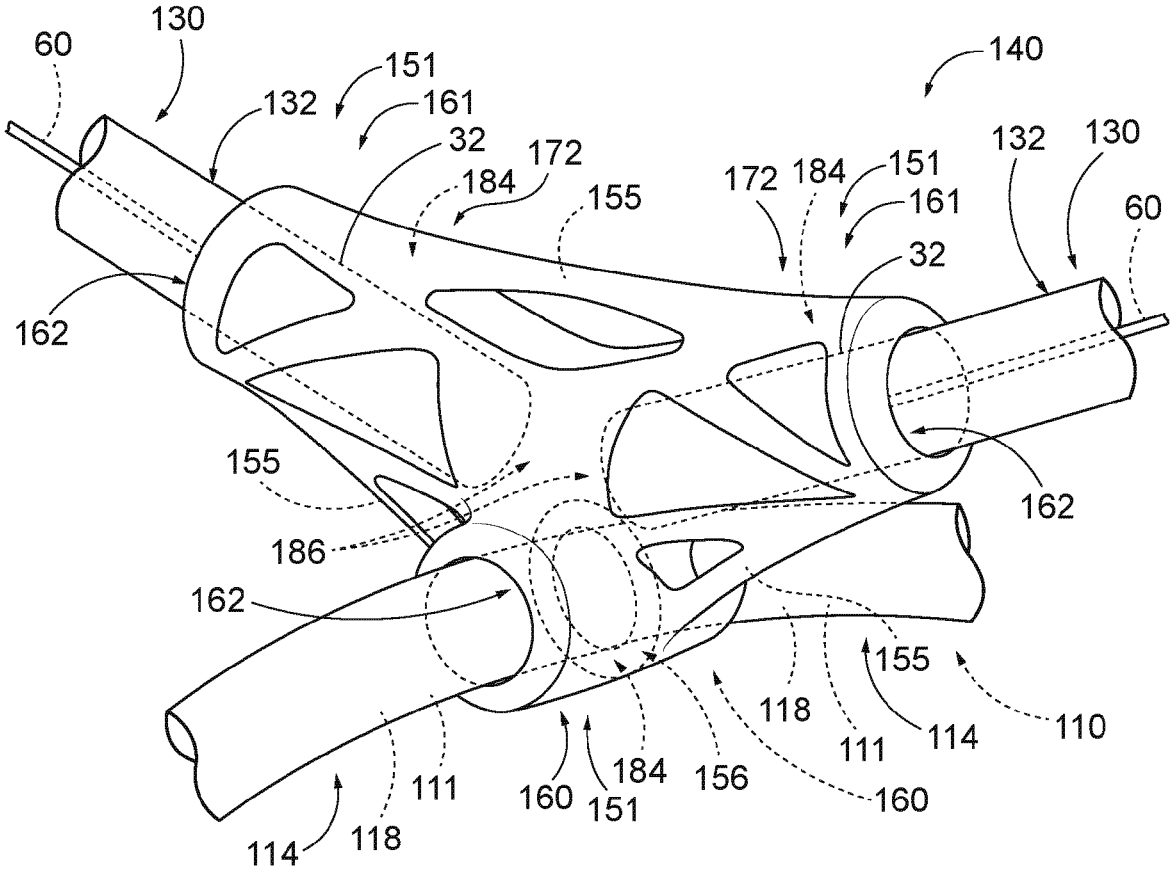

[Fig. 16]
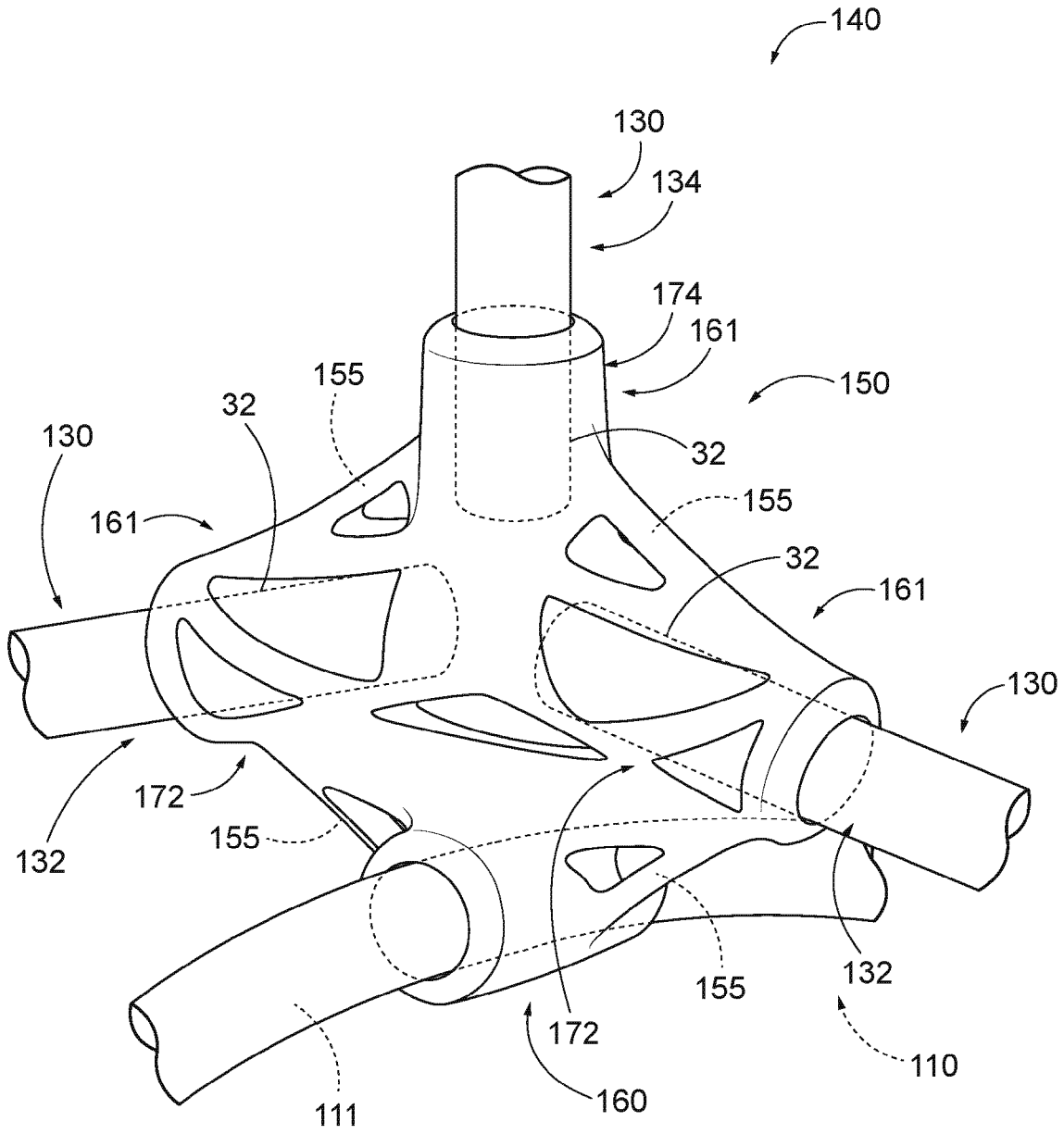

[Fig. 17]
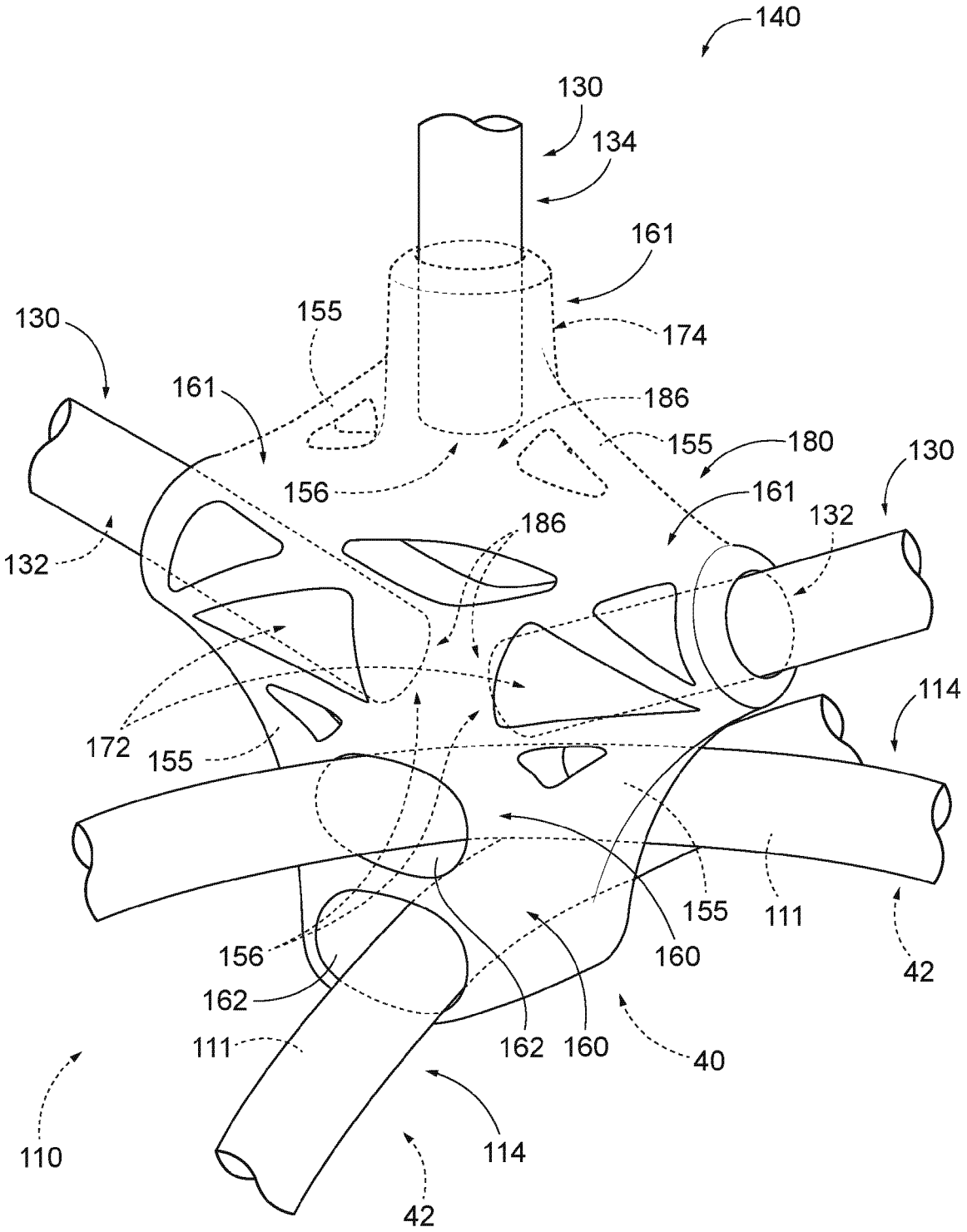

[Fig. 18]
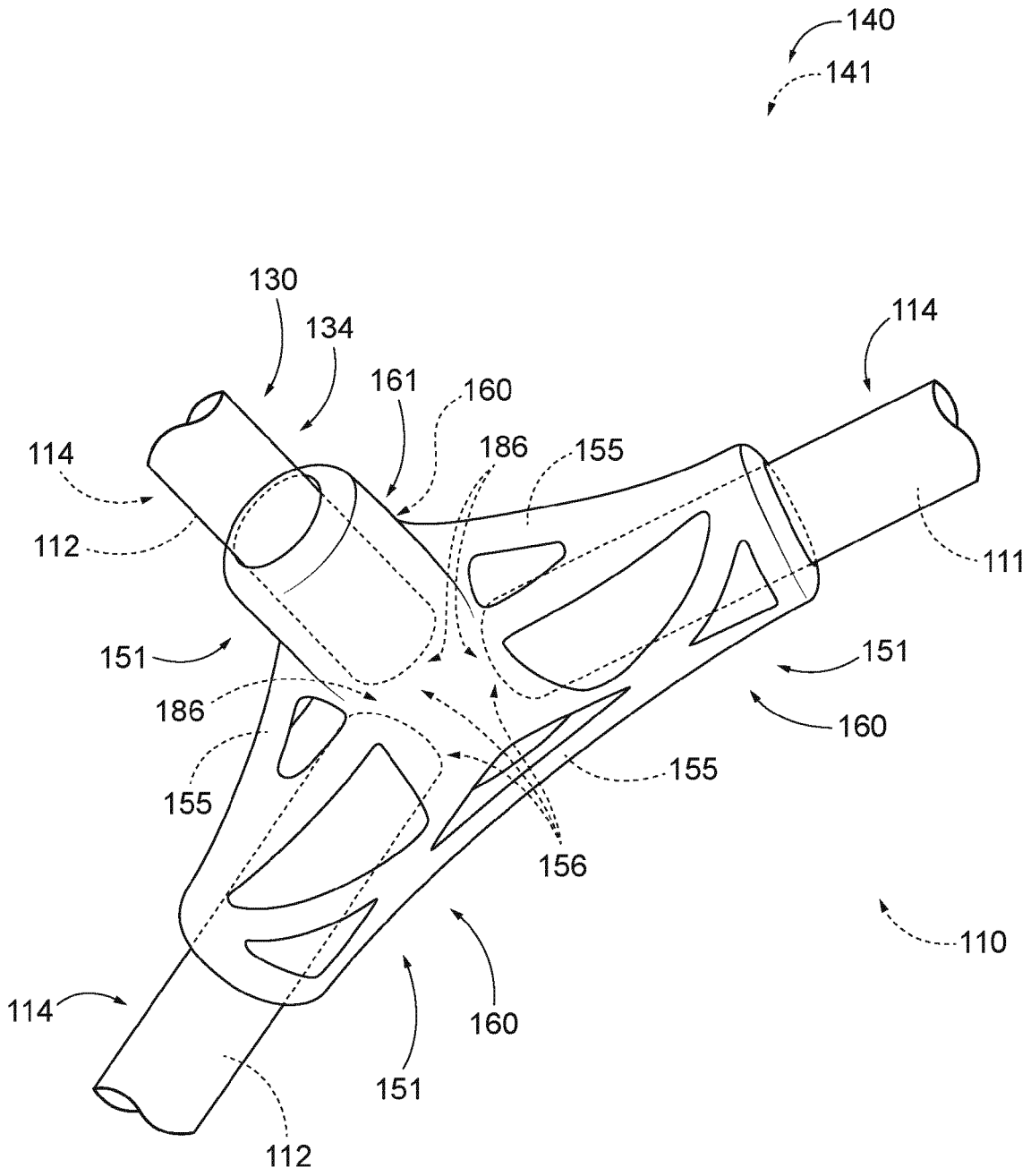

[Fig. 19]
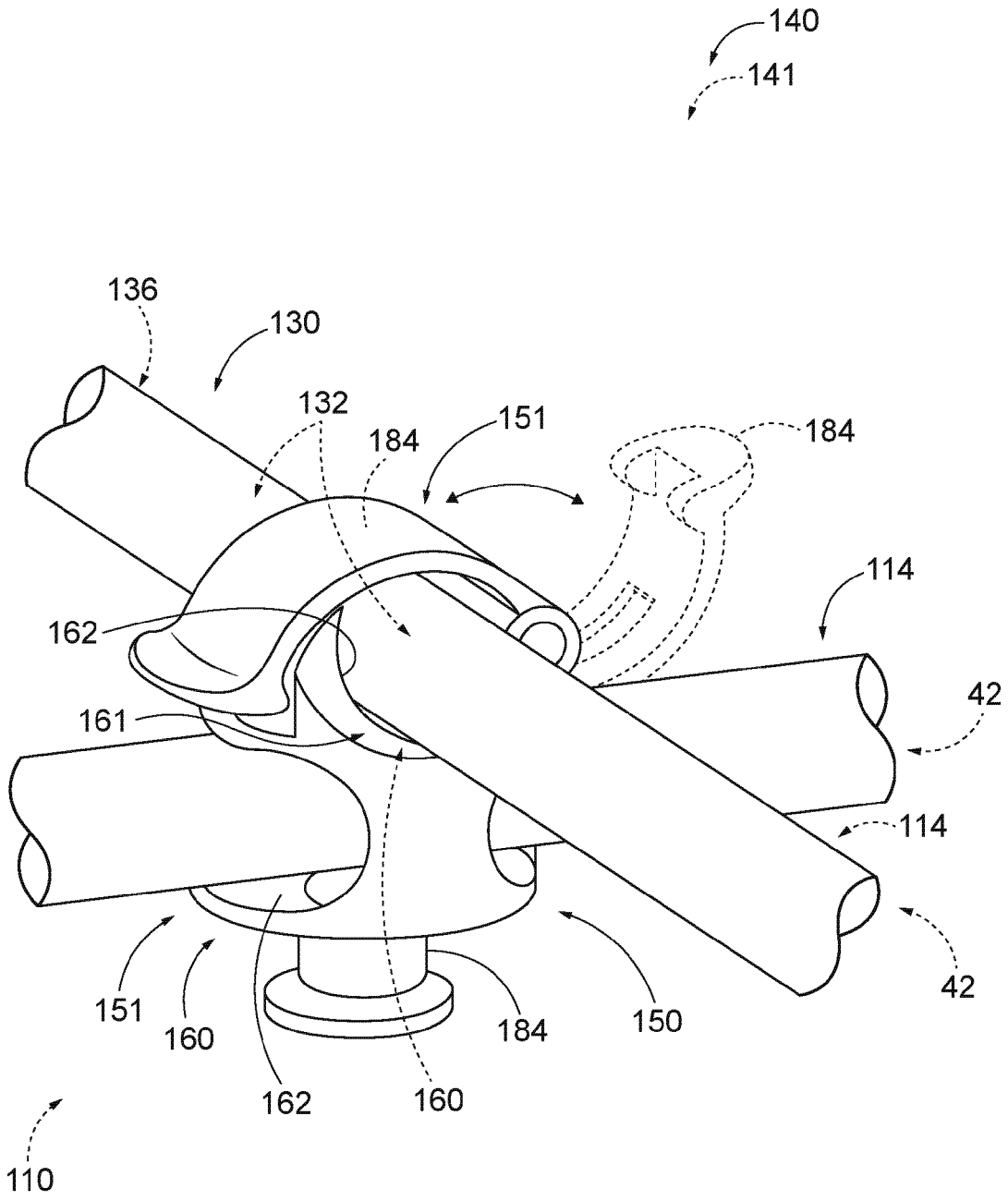

[Fig. 20]
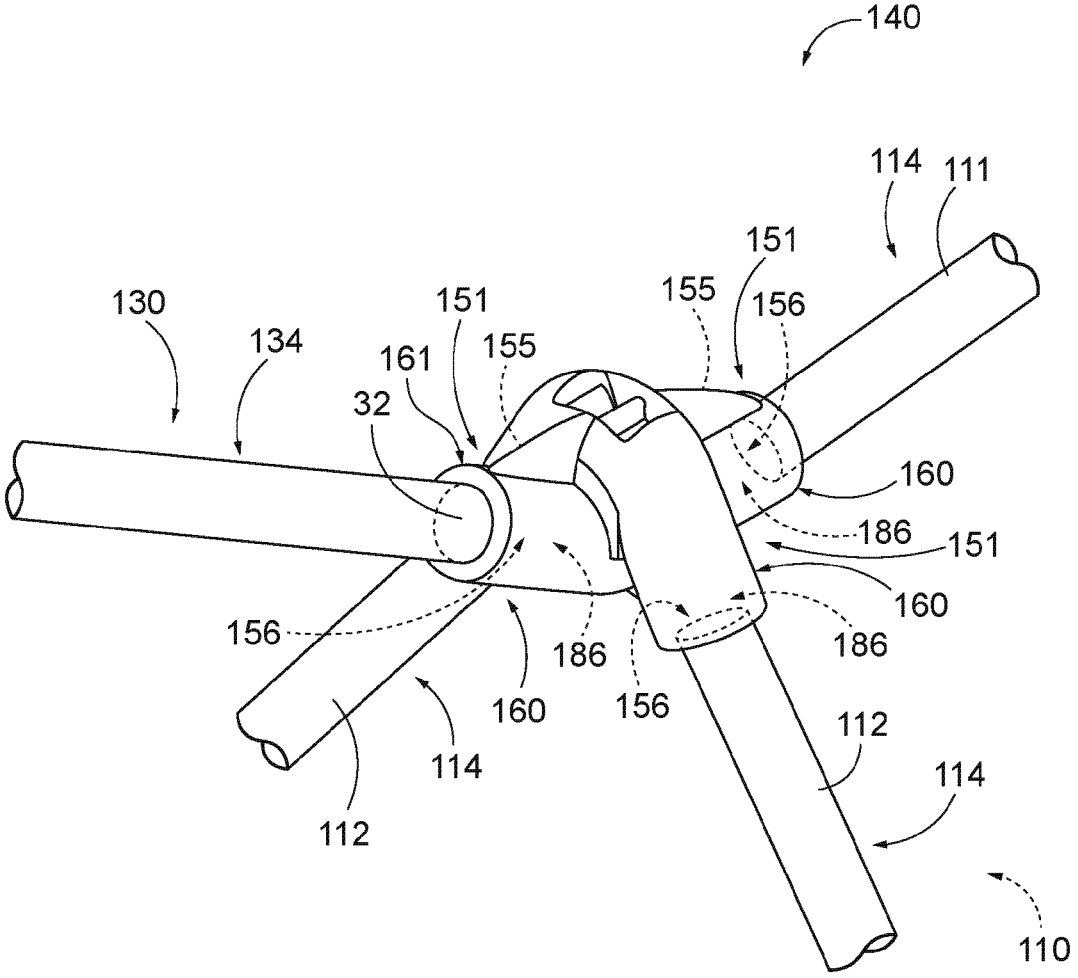

[Fig. 21]
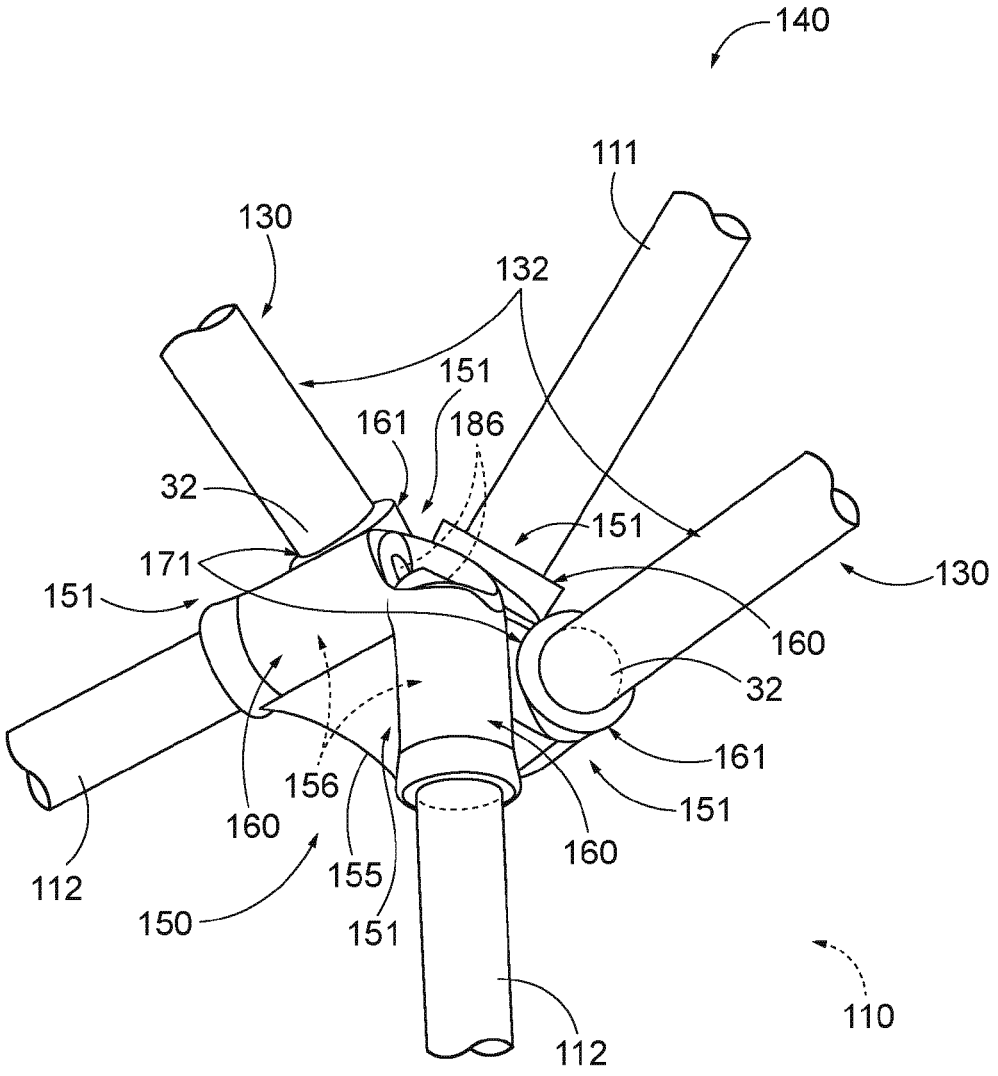

TENTS

TECHNICAL FIELD

The present disclosure relates to tents, and more particularly to tents with improved clearance.

BACKGROUND ART

A tent typically includes a plurality of tent poles, which form an assembled tent frame, and one or more tent fabrics that are supported by the tent frame to form a temporary shelter or an enclosed space. Generally speaking, conventional tent frames are constructed from rigid or flexible tent poles that, when assembled, form a tent frame that has a rounded or upwardly tapered shape. A tent fabric supported on these assembled tent frames will follow the shape or contour of the frame, thereby causing the enclosure to be narrower or tapered towards the top of the tent. In this way, conventional tents typically have limited headspace and low entrance heights, which encumber access and movement within the tent. Additionally, when a rainfly is used with these conventional tent constructions, the concave-down shape imparted on the rainfly by the tent frame limits the opening heights for airflow that can be formed within the rainfly and restricts ventilation.

DISCLOSURE OF INVENTION

Technical Problem

Some conventional tents incorporate a ridgepole with one or more ends that cantilever from the rounded tent frame to suspend the upper regions of the tent fabric or rainfly further away from the other tent poles, such as to provide an awning, improve headspace, or improve ventilation within the tent. Conventionally, the ends of the ridgepole are cantilevered in a horizontal manner that causes the strength of each cantilevered end to diminish the further it extends from the rounded tent frame. In this way, each cantilevered end, and often the entire ridgepole, is bowed downwardly under the weight of a tent fabric or rainfly, thereby diminishing headspace, further reducing the height of the entranceway, and impeding ventilation. Thus, a need exists for tent constructions with greater clearance, such as to provide higher entranceways, greater headspace, and improved ventilation.

Solution to Problem

The present disclosure is directed to tents, and particularly to tents that include at least one clearance pole. A tent according to the present disclosure includes a tent frame that, when assembled, forms an assembled tent frame that is configured to support the tent on a support surface and defines an inner space between the assembled tent frame and the support surface. The tent also includes at least one clearance pole and a clearance mechanism. When operatively coupled to the assembled tent frame, the at least one clearance pole extends away from the inner space to define an outer space. The clearance mechanism is configured to operatively couple the at least one clearance pole to the assembled tent frame and orient the at least one clearance pole to project in an upward direction relative to the support surface. The clearance mechanism includes a connector that is configured to operatively couple the clearance pole to the assembled tent frame, and which may be configured to orient a proximal end of the at least one clearance pole to extend in the upward direction. The clearance mechanism also may include a tensioning structure that extends between the at least one clearance pole and at least one other portion of the tent and which is configured to tension the at least one clearance pole in the upward direction. The tent according to the present disclosure further may include one or more of an inner tent fabric and an outer tent fabric. The inner tent fabric surrounds at least a portion of the inner space and is configured to be operatively coupled to the assembled tent frame and optionally the at least one clearance pole. The outer tent fabric surrounds at least a portion of the outer space and is configured to be operatively supported by at least the distal end of the at least one clearance pole.

BRIEF DESCRIPTION OF DRAWINGS

FIG. 1 is a schematic representation of examples of tents according to the present disclosure.

FIG. 2 is a less schematic isometric view illustrating examples of tents according to the present disclosure.

FIG. 3 is a partial cut-away end view of the examples of tents of FIG. 2.

FIG. 4 is a less schematic isometric view illustrating examples of tents according to the present disclosure.

FIG. 5 is a less schematic isometric view illustrating examples of tents according to the present disclosure.

FIG. 6 is a less schematic isometric view illustrating examples of tents according to the present disclosure.

FIG. 7 is a less schematic isometric view illustrating examples of tents according to the present disclosure.

FIG. 8 is a less schematic isometric view illustrating examples of tents according to the present disclosure.

FIG. 9 is a less schematic isometric view illustrating examples of tents according to the present disclosure.

FIG. 10 is a less schematic isometric view illustrating examples of tents according to the present disclosure.

FIG. 11 is a less schematic isometric view illustrating examples of tents according to the present disclosure.

FIG. 12 is a less schematic isometric view illustrating examples of tents according to the present disclosure.

FIG. 13 is a schematic representation of connectors that may be included in and/or utilized with tents, according to the present disclosure FIG. 14 is a less schematic partially exploded view illustrating examples of connectors according to the present disclosure.

FIG. 15 is a less schematic isometric view illustrating examples of connectors according to the present disclosure.

FIG. 16 is a less schematic isometric view illustrating examples of connectors according to the present disclosure.

FIG. 17 is a less schematic isometric view illustrating examples of connectors according to the present disclosure.

FIG. 18 is a less schematic isometric view illustrating examples of connectors according to the present disclosure.

FIG. 19 is a less schematic isometric view illustrating examples of connectors according to the present disclosure.

FIG. 20 is a less schematic isometric view illustrating examples of connectors according to the present disclosure.

FIG. 21 is a less schematic isometric view illustrating examples of connectors according to the present disclosure.

MODE FOR THE INVENTION

Hereinafter, the examples of tents according to the present disclosure that are disclosed herein will be described in detail with reference to the accompanying drawings, in which identical or similar reference numbers are given to identical or similar elements, and an overlapping description is omitted herein. FIGS. 1-21 provide examples of tents 10 according to the present disclosure. In general, in the drawings, elements that are likely to be included in a given example are illustrated in solid lines, while elements that are optional or alternatives are illustrated in broken lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labelled with like numbers in each of FIGS. 1-21, and these elements may not be discussed in detail herein with reference to each of FIGS. 1-21. Similarly, all elements may not be labelled in each of FIGS. 1-21, but reference numbers associated therewith may be utilized herein for consistency. Elements, components, and/or features that are discussed herein with reference to one or more of FIGS. 1-21 may be included in and/or utilized with any of FIGS. 1-21 without departing from the scope of the present disclosure.

It should be understood that the accompanying drawings are provided to facilitate the understanding of the embodiments disclosed herein, and the technical spirit disclosed herein is not limited by the accompanying drawings and covers all modifications, equivalents, or substituents included in the spirit and technical scope of the present disclosure. Similarly, so as not to detract from the core subject matter of the present disclosure, known and/or conventional tent features are not necessarily illustrated.

Terms including ordinal numbers such as "first," "second," and the like may be used to describe various elements, but such elements are not limited by these terms. The terms are only used to distinguish one element from another within a particular example, and these various elements may include the same or substantially similar components, features, and/or functions while being assigned different ordinal numbers.

It will be understood that when an element is referred to as being "connected to," "coupled to," "operably connected to," or "operably coupled to" another element, it can be directly connected to the other element or intervening elements may be present. When intervening elements are present, the element may be referred to as being indirectly connected or interconnected to the other element.

As used herein, the singular forms are intended to include the plural forms as well, unless the context clearly indicates otherwise.

It will be further understood that the terms "comprises" or "includes," when used in this specification, specify the presence of stated features, integers, steps, operations, elements, components, or groups thereof, but do not preclude the presence or addition of one or more other features, integers, steps, operations, elements, components, or groups thereof.

FIG. 1 schematically represents examples of tents 10, according to the present disclosure. As shown, tent 10 includes a tent frame 100 that, when assembled to form an assembled tent frame 110, is configured to support tent 10 on a support surface 16 and define an inner space 12 between assembled tent frame 110 and support surface 16. Tent 10 also includes at least one clearance pole 130 and a clearance mechanism 20. Clearance pole 130, when operatively coupled to assembled tent frame 110, extends away from inner space 12 to define an outer space 14. Clearance mechanism 20 is configured to operatively couple clearance pole 130 to assembled tent frame 110 and orient clearance pole 130 to project in an upward direction relative to support surface 16. Clearance mechanism 20 may be configured to orient a substantial portion of, or the entirety of, clearance pole 130 to extend in the upward direction. As shown in FIG. 1, clearance pole 130 includes a proximal region that may be described herein as the portion of clearance pole 130 that is positioned nearest to assembled tent frame 110. The proximal region of clearance pole 130 also may be described as the portion of clearance pole 130 from which clearance pole 130 may be cantilevered. The proximal region of clearance pole 130 may include a proximal end 32 of clearance pole 130, and/or the proximal region of clearance pole 130 may include a midsection of clearance pole 130. Clearance pole 130 further includes a distal end 34 that is positioned furthest from assembled tent frame 110. Distal end 34 of clearance pole 130 additionally or alternatively may be described as free end 34, projecting end 34, and/or clearance end 34. Clearance mechanism 20 may be configured to orient proximal end 32 of clearance pole 130 and/or distal end 34 of clearance pole 130 to extend in the upward direction. Stated in different terms, when clearance mechanism 20 orients clearance pole 130 to project in the upward direction, distal end 34 of clearance pole 130 is positioned further from support surface 16, assembled tent frame 110, and/or inner space 12 than proximal end 32, or the proximal region, of clearance pole 130.

In particular, clearance mechanism 20 includes a connector 140 that is configured to operatively couple clearance pole 130 to tent frame 100. Connector 140 may be configured to operatively couple to proximal end 32 of clearance pole 130 and orient proximal end 32 of clearance pole 130 to extend in the upward direction, when connector 140 operatively couples clearance pole 130 to assembled tent frame 110. Additionally or alternatively, connector 140 may be configured to operatively couple to the midsection of clearance pole 130.

As indicated in dot-dot-dash lines in FIG. 1, clearance mechanism 20 also may include a tensioning structure 30 that is configured to operatively couple to any suitable region of clearance pole 130 and at least one other portion of tent 10 to tension clearance pole 130 to project in the upward direction when clearance pole 130 is operatively coupled to assembled tent frame 110. For example, tensioning structure 30 may be configured to operatively couple to at least distal end 34 of clearance pole 130 and at least one other portion of tent 10 to tension at least distal end 34 of clearance pole 130 in the upward direction. When connector 140 operatively couples to the midsection of clearance pole 130, clearance pole 130 may be described as having a pair of distal ends 34 that extend away from inner space 12 to define outer space 14. Tensioning structure 30 may extend between the pair of distal ends 34 of clearance pole 130 to tension the pair of distal ends 34 in the upward direction against one another, such that both distal ends 34 project in the upward direction and/or are positioned above the proximal region of clearance pole 130. Stated in more general terms, clearance mechanism 20 may orient clearance pole 130 to diverge outwardly from the curvature of assembled tent frame 110 and/or to diverge outwardly from the tangent plane formed along assembled tent frame 110 at the location where connector 140 couples clearance pole 130 to assembled tent frame 110.

As discussed herein, the upward direction may refer to any direction having a component directed perpendicularly and positively away from support surface 16. For example, when support surface 16 is a horizontal plane and/or a level ground surface, the upward direction may include any direction that has a positive vertical component and/or a component that opposes a direction of gravity. As a more specific example, when support surface 16 is a horizontal plane, clearance pole 130 will project in a direction that includes a positive vertical component and/or a component that opposes gravity.

When clearance pole 130 is operatively coupled to assembled tent frame 110 and oriented by clearance mechanism 20, clearance pole 130 may form a clearance angle, which may be defined as the angle formed between a line extending from proximal end 32 to distal end 34 of clearance pole 130 and a plane defined by support surface 16, in which proximal end 32 and the plane defined by support surface 16 form the vertex of the angle. As examples, the clearance angle may be at least 2°, at least 4° at least 6°, at least 10°, at least 20°, at least 40°, at most 60°, at most 80°, and/or at most 90°.

Support surface 16 includes any suitable and/or any desirable support surface 16. As examples, support surface 16 may include a ground surface, a rocky surface, a grassy surface, a dirt surface, a sleeping platform, a cot, the bed of a vehicle, a built floor, a raised surface, and/or a building floor. Support surface 16 also may include a horizontal surface, a substantially horizontal surface, a level surface, a sloped surface, an even surface, and/or an uneven surface. In other words, assembled tent frame 110 may be configured to be supported by any suitable support surface 16. In general, when an element, group of elements, and/or a structure is discussed herein as being supported on support surface 16, at least a portion of the element, elements, and/or structure may be supported on support surface 16 in any suitable manner, such as by being inserted into support surface 16, extending against support surface 16, by being received in sockets or receivers that are positioned along support surface 16, and/or by extending against a tarp, fabric, or other liner that extends against support surface 16. As a specific example, as shown in FIG. 1, tent 10 may include a base surface 24, such as a tarp, a base fabric, and/or a groundsheet, and base surface 24 may include a plurality of receivers 26, such as sockets or grommets, and each receiver 26 may be configured to receive a base portion of assembled tent frame 110.

Assembled tent frame 110 may include an upwardly extending section 44 that extends away from support surface 16 to provide height to tent 10, and one or more clearance poles 130 may be operatively coupled to, and extend upwardly and outwardly from, upwardly extending section 44 to provide width and additional height to tent 10. Assembled tent frame 110 also may include at least a pair of upwardly extending sections 44 that extend away from support surface 16 to provide height to assembled tent frame 110 and at least one laterally extending section 40 that extends between upwardly extending sections 44 to create or define inner space 12. That said, upwardly extending sections 44 also may be at least partially laterally extending, and/or include a laterally extending component, such as when assembled tent frame 110 includes arcuate support members. Inner space 12 may be described as a having a cross-sectional area taken, or measured, normal to support surface 16, with such cross-sectional area being confined by upwardly extending sections 44, laterally extending section 40, and support surface 16. Clearance pole 130 may extend from any suitable region of upwardly extending sections 44 and/or laterally extending section 40 to project in the upward direction and away from inner space 12 to define outer space 14. As such, when operatively coupled to assembled tent frame 110, clearance pole 130 may be described as creating outer space 14 that extends beyond inner space 12 to increase a cross-sectional area of tent 10 taken normal to support surface 16 relative to the cross-sectional area of assembled tent frame 110 taken normal to support surface 16. In view of the above, clearance pole 130 also may increase a height of tent 10 at least proximate the position clearance pole 130 is operatively coupled to assembled tent frame 110, which may correspond to the total height of tent 10.

Clearance pole 130, together with clearance mechanism 20, also may be configured to provide additional support to tent 10 and/or assembled tent frame 110. More specifically, as discussed herein, clearance mechanism 20 may include tensioning structure 30 that is operatively coupled to clearance pole 130 and at least one other portion of tent 10, with tensioning structure 30 tensioning clearance pole 130 against the at least one other portion of tent 10. Connector 140 may distribute at least a portion of the tension applied to clearance pole 130 by tensioning structure 30 to the region of assembled tent frame 110 to which connector 140 is coupled. In other words, tensioning structure 30 and clearance pole 130 may be described as creating a tensioned pair between discrete regions of tent 10. The tensioned pair formed with tensioning structure 30, clearance pole 130, and the at least one other portion of tent 10 may serve to reinforce and/or distribute forces about tent 10 and/or assembled tent frame 110, which may benefit load distribution about tent 10 and/or assembled tent frame 110 and/or benefit the resilience of tent 10 and/or assembled tent frame 110 towards external forces, such as wind, rain, and/or snow loading.

As discussed herein, clearance pole 130 also may be referred to as divergent pole 130, upwardly projecting pole 130, outer space pole 130, and/or lofting pole 130. Tent 10 may include a plurality of clearance poles 130, in which each clearance pole 130 may be operatively coupled to assembled tent frame 110 via a single connector 140 or respective connectors 140, and oriented, as discussed herein, by clearance mechanism 20. As shown in FIG. 1, when tent 10 includes a plurality of clearance poles 130, tensioning structure 30 may extend between two or more clearance poles 130 to tension the two or more clearance poles 130 in the upward direction. More specifically, tensioning structure 30 may extend between at least distal ends 34 of two or more clearance poles 130 to tension at least distal ends 34 of the two or more clearance poles 130 in the upward direction. Tensioning structure 30 also may form a tensioned pair between the two or more clearance poles 130, such as to reinforce tent 10 and/or assembled tent frame 110, as discussed herein.

Two clearance poles 130 may extend from a single connector 140 to form a pair of clearance poles 132, which additionally or alternatively may be referred to herein as a pair of ridge poles 132 and/or a clearance pole pair 132. Connector 140 may operatively couple to proximate ends 32 of each clearance pole 130 of pair of clearance poles 132 and orient pair of clearance poles 132 to extend from connector 140 in opposing upward directions relative to one another. More specifically, connector 140 may orient pair of clearance poles 132 to extend from connector 140 in opposing radial directions relative to one another, while also orienting both clearance poles 130 to project upwardly relative to support surface 16 and/or away from inner space 12. In other words, pair of clearance poles 132 may form a V-shaped, or convex, configuration when pair of clearance poles 132 is viewed in a side profile and may form a straight line when pair of clearance poles 132 is viewed as a top plan. Tensioning structure 30 may extend between clearance poles 130 of pair of clearance poles 132, such as distal ends 34 thereof, to form a tensioned pair therebetween. Tensioning structure 30 also may tension pair of clearance poles 132 against one another to project in the upward direction. Alternatively, connector 140 may orient proximal ends 32 of each clearance pole 130 of pair of clearance poles 132 to extend downwardly, while tensioning structure 30 tensions each clearance pole 130, such as distal ends 34 thereof, to extend in the upward direction, such that each clearance pole 130 of pair of clearance poles 132 projects in the upward direction.

Pair of clearance poles 132 optionally may be formed from a single clearance pole 130. More specifically, connector 140 may operatively couple to the midsection of the single clearance pole 130, such that the single clearance pole 130 extends from connector 140 to form a pair of distal ends 34 that extend away from inner space 12, and tensioning structure 30 may tension distal ends 34 to project in the upward direction.

Tent 10 may include a plurality of clearance pole pairs 132, and each pair of clearance poles 132 may be operatively coupled to a discrete region of assembled tent frame 110. Additionally, tensioning structure 30 may extend between two or more clearance pole pairs 132 to form a tensioned network therebetween.

Clearance mechanism 20 may orient each pair of clearance poles 132 to form a clearance pair angle between the two clearance poles 130. The clearance pair angle formed between pair of clearance poles 132 may be defined as an angle formed between lines extending from connector 140 to distal ends 34 of the two clearance poles. Connector 140 may orient at least proximal ends 32 of each clearance pole 130, and/or tensioning structure 30 may orient at least distal ends 34 of each clearance pole 130, such that clearance pole pair 132 forms a desired clearance pair angle therebetween. As examples, each clearance pole pair 132 may form a clearance pair angle that is at least 70° , at least 80° , at least 90° , at least 100° , at least 130° , at least 140° , at most 150° , at most 160° , at most 165° , at most 170° , and/or at most 175° .

As shown in FIG. 1, tent 10 also may include at least one auxiliary pair of clearance poles 136. Auxiliary pair of clearance poles 136 may include two clearance poles 130 that are operatively coupled to and extend in opposing directions from a clearance pole connector 142 to form a V-shape or convex shape. Each clearance pole 130 of auxiliary pair of clearance poles 136 is operatively coupled to a separate portion of assembled tent frame 110 by a separate connector 140, and connectors 140 orient at least distal ends 34 of auxiliary pair of clearance poles 136 to extend away from inner space 12 to define outer space 14 and to project upwardly relative to support surface 16. As shown, tensioning structure 30 may extend between auxiliary pair of clearance poles 136, such as distal ends 34 thereof, to at least one other portion of tent 10, such as one or more other clearance poles 130.

Tent 10 additionally or alternatively may include one or more clearance poles 130 that extend from connector(s) 140 independently without forming a pair of clearance poles, and these clearance poles 130 may be referred to herein as individual clearance poles 134. Individual clearance poles 134 also may be referred to herein as independent clearance poles 134 and/or horn shafts 134. For example, tent 10 may include a plurality of individual clearance poles 134, and each individual clearance pole 134 may be operatively coupled to a discrete region of assembled tent frame 110 via a separate connector 140. Individual clearance pole 134 also may be operatively coupled to the same connector 140 as a pair of clearance poles 132, with connector 140 orienting individual clearance pole 134 separately from pair of clearance poles 132. When tent 10 includes two or more individual clearance poles 134, tensioning structure 30 may extend between two or more individual clearance poles 134, such as distal ends 34 thereof, to form a tensioned pair and/or a tensioned network therebetween. Additionally or alternatively, tent 10 may include at least one pair of clearance poles 132 and at least one individual clearance pole 134, and tensioning structure 30 may form a tensioned network between the at least one individual clearance pole 134 and the at least one pair of clearance poles 132.

Tensioning structure 30 may include any suitable structure for tensioning at least one clearance pole 130 against at least one other portion of tent 10. As examples, tensioning structure 30 may include one or more cords, one or more straps, one or more elastic cords, a fabric and/or one or more ropes. Tensioning structure 30 also may include a plurality of couplers, including at least one coupler that operatively couples to clearance pole 130, such as distal end 34 thereof, and a second coupler that operatively couples tensioning structure 30 to another region of tent 10, such as distal end 34 of another clearance pole 130. As discussed in more detail herein, tent 10 may include an outer tent fabric 120, and outer tent fabric 120 may include tensioning structure 30.

As shown in dotted lines in FIG. 1, tent 10 may include an inner tent fabric 122 that is configured to be operatively coupled to assembled tent frame 110 and surround at least a portion of inner space 12. Inner tent fabric 122 also may be operatively coupled to one or more clearance poles 130. In particular, inner tent fabric 122 may be configured to be hung from, suspended from, and/or tensioned within assembled tent frame 110 and optionally one or more clearance pole 130. As a more specific example, inner tent fabric 122 may be hung from or suspended from a midsection, and/or distal end 34 of one or more clearance poles 130.

Generally speaking, inner tent fabric 122 may be utilized to form an enclosed, covered, and/or livable space within tent 10. Inner tent fabric 122 may include a plurality of sides, such as a base that forms a floor for tent 10 and a plurality of walls that extend from the base to the sidewalls, roof, and/or an awning to the enclosed space. With this in mind, inner tent fabric 122 may include one or more doors that provide ingress and egress to the enclosed space. When inner tent fabric 122 is operatively coupled to, such as hung or suspended from, one or more clearance poles 130, inner tent fabric 122 may surround at least a portion of outer space 14, extend above at least a portion of inner space 12, and/or extend above at least a portion of assembled tent frame 110. As such, when inner tent fabric 122 is operatively coupled to clearance poles 130, clearance poles 130 may increase the height of the enclosed space formed by inner tent fabric 122 and/or increase the volume of the enclosed space formed by inner tent fabric 122 relative to when inner tent fabric 122 is operatively coupled to assembled tent frame 110 alone. Stated differently, clearance pole(s) 130 may provide tent 10 with an enclosed or living space that is larger in volume or higher than the living space provided by conventional tents with an otherwise identical assembled tent frame that does not include a clearance pole 130 and a clearance mechanism 20. Additionally, inner tent fabric 122 may be operatively coupled to clearance pole(s) 130 such that the one or more doors or entranceways of inner tent fabric 122 are positioned below clearance pole(s) 130. In this case, clearance pole(s) 130 may increase the door or entranceway height of inner tent fabric 122 to improve ingress and egress to tent 10.

As shown in dot-dash lines in FIG. 1, tent 10 additionally or alternatively may include an outer tent fabric 120 that is configured to be operatively coupled to and/or supported by distal end 34 of at least one clearance pole 130 and surround at least a portion of outer space 14. In other words, clearance pole 130 may be configured to support outer tent fabric 120 spaced apart from at least a portion of assembled tent frame 110 and/or inner space 12. Outer tent fabric 120 also may be configured to surround at least a portion of, or the entirety of, assembled tent frame 110 and/or inner space 12. When tent 10 includes a plurality of clearance poles 130, each clearance pole 130 of the plurality of clearance poles 130 may be configured to be operatively coupled to and/or support a region of outer tent fabric 120. Stated another way, each clearance pole 130 may be configured to support a discrete region of outer tent fabric 120 spaced apart from and/or suspended above a respective region of assembled tent frame 110 and/or inner space 12.

Outer tent fabric 120 also may be operatively coupled to one or more additional regions of the assembled tent 10, such as base portions of assembled tent frame 110 and/or anchors 28 installed along support surface 16.

Outer tent fabric 120 may include and/or may be a rainfly, a tarp, and/or any other fabric member that is configured to prevent moisture from entering tent 10. In many conventional tents, the rainfly generally is supported directly upon a roof region of the assembled tent frame. During use, condensation often forms along the inner surface of the rainfly due to the presence of humid air within the tent, and the curvature of the rainfly causes the condensation to accumulate along the contact area between the rainfly and the assembled tent frame, which may cause water to collect within the tent. As illustrated in FIG. 1, the presence of one or more clearance poles 130 in tent 10 solves this problem by supporting outer tent fabric 120 spaced apart from at least a portion of assembled tent frame 110, thus mitigating the collection of condensation therebetween.

As further shown in FIG. 1, when tent 10 includes both inner tent fabric 122 and outer tent fabric 120, clearance pole(s) 130 may support outer tent fabric 120 spaced apart from inner tent fabric 122 with a clearance volume 22 being formed therebetween. The spacing of outer tent fabric 120 from inner tent fabric 122 by clearance poles 130 may provide several benefits over conventional tents that do not include a clearance pole 130. For example, clearance volume 22 may prevent outer tent fabric 120 from contacting inner tent fabric 122 and avoid moisture from being transferred from outer tent fabric 120 to inner tent fabric 122. Additionally, clearance volume 22 provided by clearance poles 130 may provide ventilation and/or facilitate airflow within tent 10 and/or between inner tent fabric 122 and outer tent fabric 120, which may prevent condensation from forming or accumulating on inner tent fabric 122 and/or outer tent fabric 120.

Outer tent fabric 120 may include tensioning structure 30. In particular, as shown in FIG. 1, outer tent fabric 120 may include one or more pole receivers 124 that are configured to operatively couple to clearance pole 130, such as distal end 34 thereof. With pole receivers 124, outer tent fabric 120 may be configured to tension a particular clearance pole 130 against another region of tent 10, such as another clearance pole 130, to form a tensioned pair therebetween and/or tension clearance pole(s) 130 in the upward direction.

Each clearance pole 130 also may be described as a tensile member that imparts an outward force on outer tent fabric 120 to tension outer tent fabric 120 into a desired shape. As shown in FIG. 1, the tension in outer tent fabric 120 may cause outer tent fabric 120 to adopt an angular geometry, which may enhance the capacity of outer tent fabric 120 to shed snow and/or direct precipitation away from inner space 12 and/or outer space 14. The angular geometry of outer tent fabric 120 also may enhance the ability of outer tent fabric 120 to direct condensation that may form on the inner surface of outer tent fabric 120 to roll away from the internal volume of tent 10 and prevent collection of dripping therein.

With continued reference to FIG. 1, assembled tent frame 110 may include at least one support frame 42, which may be described as a structural unit that includes a pair of ends, or end regions, that are supported on support surface 16. For example, the pair of ends of support frame 42 may extend against support surface 16 and/or be received in receivers 26 of base surface 24. Support frame 42 extends upwardly from support surface 16, or the pair of ends, to form a closed shape with support surface 16. More specifically, support frame 42 may include at least a pair of upwardly extending sections 44 that extend upwardly from support surface 16, and the upper ends of upwardly extending sections 44 may be joined together to form a closed shape. Support frame 42 also may include a laterally extending section 40 that extends between and interconnects upwardly extending sections 44 to form the closed shape. As examples, support frame 42 and support surface 16 may form a shape that is generally arcuate, semicircular, elliptical, parabolic, hyperbolic, triangular, rectangular, and/or pentagonal.

Support frame 42 may include at least one frame pole 114. Frame pole 114 also may be referred to herein as tent pole 114, support pole 114, tent rod 114, support rod 114, and/or tent frame member 114. When support frame 42 includes a single frame pole 114, frame pole 114 may be bent in an arcuate shape such that both ends of frame pole 114 are supported by support surface 16 and the remainder of frame pole 114 extends above support surface 16 to the closed shape. When support frame 42 includes a single frame pole 114, the single frame pole 114 may be referred to herein as a unit pole.

Support frame 42 also may include a plurality of frame poles 114. For example, support frame 42 may include a pair of leg poles 112 that extend upwardly from support surface 16 and each have one end, which also may be referred to as a base end, that is supported by support surface 16. The other ends, which also may be referred as upper ends, of leg poles 112 may be operatively coupled to one another to form the closed shape, such as a triangle or other three-sided shape.

Additionally or alternatively, support frame 42 may include a roof pole 111 that extends between and is operatively coupled to the upper ends of both leg poles 112 to form the closed shape. For example, the closed shape formed by support frame 42 having a pair of leg poles 112 and roof pole 111 may include a rectangular shape, a rectangular shape with one or more rounded sides, a rhombic shape, a diamond shape, and/or a substantially arcuate shape. Generally speaking, roof pole 111 may include laterally extending section 40, and leg poles 112 may include upwardly extending sections 44.

Clearance pole(s) 130 may be operatively coupled along any suitable region of support frame 42 via connector 140 and extend from support frame 42 in any suitable manner. For example, one or more clearance poles 130, such as pair of clearance poles 132, may be operatively coupled to roof pole 111 via connector 140, and connector 140 may orient pair of clearance poles 132 to extend traverse to roof pole 111. Additionally or alternatively, one, or both ends of roof pole 111 may be operatively coupled to leg pole(s) 112 via connector 140, and one or more clearance poles 130 may extend from connector 140. As another example, the upper ends of two leg poles 112 may be operatively coupled to one another via connector 140, and one or more clearance poles 130 may extend from connector 140.

As shown in FIG. 1, assembled tent frame 110 may include a plurality of support frames 42, such as at least 2, at least 3, at least 4, at least 6, and/or at most 10 support frames 42. When assembled tent frame 110 includes a plurality of support frames 42, support frames 42 may be interconnected in any suitable manner to form assembled tent frame 110 and/or to create inner space 12 with any suitable shape. Support frames 42 may be arranged within assembled tent frame 110 to cross over one another. For example, as discussed herein, two or more support frames 42 each may include a pair of upwardly extending sections 44 and a laterally extending section 40. The two or more support frames 42 may cross over one another proximate the respective laterally extending sections 40 and/or proximate an apex 70 of assembled tent frame 110. Additionally or alternatively, the two or more support frames 42 may be arranged such that laterally extending sections 40 are aligned, or substantially parallel to one another, and the two or more support frames 42 cross over one another along upwardly extending sections 44. In any case, connector 140 may operatively couple support frames 42 to one another about an intersection where support frames 42 cross over, and one or more clearance poles 130 may extend from connector 140.

Assembled tent frame 110 may include a roof pole 111 that interconnects support frame 42 to another support member, in which the support member may be spaced apart from support frame 42 along support surface 16, and the support member includes at least one end that is supported by support surface 16. As an example, the support member may include a single leg pole 112 having a base end that is supported by support surface 16, and roof pole 111 may extend between support frame 42 and the other, or upper end, of the leg pole 112, such that assembled tent frame 110 includes three ends that are supported by support surface 16. The support member also may include a second support frame 42, such that assembled tent frame 110 includes a pair of spaced-apart support frames 42 that are interconnected via roof pole 111. For example, the second support frame 42 may include a pair of leg poles 112 that are joined together to form a second support frame 42 or an arcuate unit pole 311 having a pair of ends that operatively contact support surface 16. Roof pole 111 may be operatively coupled to support frame 42 and/or the support member via connector(s) 140, and one or more clearance poles 130 may extend from each connector 140.

With continued reference to FIG. 1, assembled tent frame 110 additionally or alternatively may be described as including at least one frame pole 114, such as unit pole 311, and/or a plurality of interconnected frame poles 114 that are interconnected to form assembled tent frame 110. Frame poles 114 may include leg poles 112, roof poles 111, and/or unit poles 311. Each frame pole 114 and each clearance pole 130 may be formed from any suitable material such as aluminum or another metal or alloy, fiberglass, carbon fiber, a polymer, a polymeric material, a plastic, and/or combinations thereof. Each frame pole 114 may be formed as a one-piece structure. Alternatively, at least one frame pole 114, and optionally all frame poles 114, may be formed form a plurality of pole segments 118 that are interconnected in an end-to-end relationship to define a segmented frame pole. Each pole segment 118 of the segmented frame pole may be partially telescoping and may be interconnected by a flexible cord, such as an elastic cord, that urges pole segments 118 to remain interconnected once assembled in an end-to-end relationship. Likewise, each clearance pole 130 also may be formed from a plurality of pole segments 118 that are interconnected in an end-to-end relationship and may be partially telescoping and/or interconnected by a flexible cord, such as an elastic cord. When frame pole 114 includes a plurality of pole segments 118, any two given pole segments 118 may be separated by a connector 140 or a frame pole connector 141, while still defining a single frame pole 114. In other words, a single frame pole 114 may be described as extending through connector 140 or frame pole connector 141 while two pole segments 118 thereof are positioned on either side of, or separated by, connector 140 or frame pole connector 141.

Frame poles 114 may be interconnected by any suitable mechanism. For example, as shown in FIG. 1, frame poles 114 may be interconnected via one or more connectors 140 and/or frame pole connectors 141. Each frame pole 114 may include an elastic cord that extends within frame pole 114, and two more frame poles 114 may be elastically interconnected to one another via the elastic cord. When two frame poles 114 are interconnected via a single connector 140 or a single frame pole connector 141, the elastic cord may extend through connector 140 or frame pole connector 141 to interconnect the two frame poles 114. Similarly, each clearance pole 130 may include an elastic cord that extends therein, and two or more clearance poles 130 may be elastically interconnected to one another via the elastic cord. For example, pair of clearance poles 132 may include an elastic cord that elastically interconnects pair of clearance poles 132 through connector 140.

Tent 10 may include an assembled state 18, such as shown and discussed herein with reference to FIG. 1, and a disassembled state. The disassembled state may comprise tent frame 100 disassembled to not form inner space 12, and clearance pole(s) 130 disengaged from tent frame 100, or removed from connector(s) 140. Tent 10 may be configured to be selectively and repeatedly assembled from the disassembled state to assembled state 18 and disassembled from assembled state 18 to the disassembled state without damage to tent frame 100, clearance pole 130, and clearance mechanism 20. In particular, each clearance pole 130 may be disengaged from tent frame 100 and/or clearance mechanism 20 when tent 10 is in the disassembled state. Additionally, each frame pole 114 may be disengaged from each other frame pole 114, as well as connectors 140 and/or frame pole connectors 141 when tent 10 is in the disassembled state. Segments 118 of frame pole 114 or clearance pole 130 may be disconnected from one another when tent 10 is in the disassembled state. When tent 10 includes inner tent fabric 122 and/or outer tent fabric 120, each of inner tent fabric 122 and outer tent fabric 120 may decoupled from frame poles 114, clearance poles 130, and/or at least a portion of clearance mechanism 20 when tent 10 is in the disassembled state. Additionally, inner tent fabric 122 and outer tent fabric 120 may be repeatedly coupled to and decoupled from assembled tent frame 110 and/or clearance poles 130 without damage to inner tent fabric 122 and outer tent fabric 120.

That said, when tent 10 is in the disassembled state, one or more components of tent 10 may remain elastically interconnected to one another. As an example, segments 118 of frame pole 114 or clearance pole 130 may remain elastically interconnected to one another when tent 10 is in the disassembled state. Additionally or alternatively, one or more of frame pole(s) 114, pole segments 118, frame pole connector(s) 141, clearance pole(s) 130, connector(s) 140, and/or combinations thereof may be elastically interconnected via one or more elastic cords, such as discussed herein, when tent 10 is in the disassembled state.

Stated in slightly different terms, tent 10 may be described as including a plurality of interconnecting sections, in which each interconnecting section is interconnected to one or more other interconnecting sections when tent 10 is in assembled state 18 and each interconnecting section may be disengaged from the one or more other interconnecting sections when the tent is in the disassembled state. When tent 10 is in the disassembled state, at least two of, some of, or all of, the interconnecting sections may remain elastically interconnected via one or more elastic cords to form an elastically interconnected network. In particular, the plurality of interconnected sections may include each connector 140, each frame pole connector 141, each frame pole 114, each clearance pole 130, and/or each connector 140. The plurality of interconnecting sections also may include pole segments 118 when one or more frame poles 114 and/or clearance poles 130 comprise pole segments 118. The plurality of interconnecting sections also may include inner tent fabric 122, outer tent fabric 120, base surface 24, anchors 28, and/or tensioning structure 30. However, inner tent fabric 122, outer tent fabric 120, base surface 24, anchors 28, and/or tensioning structure 30 may not remain elastically interconnected to the other interconnecting sections when tent 10 is in the disassembled state. When tent 10 is in the disassembled state, the plurality of interconnecting sections may be described as being or forming a kit for assembling tent 10 to assembled state 18.

When tent 10 is in the disassembled state, the plurality of interconnecting sections may be configured stored and/or transported in a condensed state. In the condensed state, each clearance pole 130, each frame pole 114, and/or each pole segment 118 may be generally aligned with one another. Tent 10 also may include a stowage bag that is configured to receive the plurality of interconnecting sections, such as while the plurality of interconnecting sections are in the condensed state.

Turning now to FIGS. 2-12, illustrative non-exclusive examples of tents 10 are illustrated. Where appropriate, the reference numerals from the schematic illustration of FIG. 1 are used to designate corresponding parts of the examples of FIGS. 2-12. However, the examples of FIGS. 2-12 are non-exclusive and do not limit tent 10 to the illustrated embodiments of FIGS. 2-12. That is, tents 10 are not limited to the specific embodiments of FIGS. 2-12, and tents 10 may incorporate any number of the various aspects, configurations, characteristics, properties, variants, options etc. of tents 10 that are illustrated in and discussed with reference to the schematic representation of FIG. 1 and/or the embodiments of FIGS. 2-12, as well as variations thereof, without requiring the inclusion of all such aspects, configurations, characteristics, properties, etc. Furthermore, any additional aspects, configurations, characteristics, properties, variants, options, etc. disclosed in connection with the tents 10 of any of FIGS. 2-12 may be used and/or otherwise included with other tents 10 according to the present disclosure, including tents 10 according to FIG. 1 or others of FIGS. 2-12. For the purpose of brevity, each previously discussed component, part, portion, aspect, region, etc. or variants thereof may not be discussed, illustrated, and/or labeled again with respect to the examples of FIGS. 2-12; however, it is within the scope of the present disclosure that the previously discussed features, variants, etc. may be utilized with the examples of FIGS. 2-12.

FIGS. 2-12 illustrate examples of tents 10 assembled in assembled state 18, in which tent frame 100 is assembled to form assembled tent frame 110, and clearance poles 130 are operatively coupled to assembled tent frame 110 via clearance mechanism 20. That said, each of the examples of tents 10 illustrated in FIGS. 2-12 also may be configured to be disassembled to the disassembled state, as discussed in detail herein. In the disassembled state, each of the examples of tent 10 illustrated in FIGS. 2-12 may include each of the same components or parts that are shown in assembled state 18 in FIGS. 2-12, and may form a kit for forming the examples of assembled tent 10 illustrated in each of FIGS. 2-12.

FIG. 2 is a perspective view showing examples of tent 10, in which tent 10 includes a pair of clearance poles 132. As shown, tent 10 includes a tent frame 100 that is assembled to form assembled tent frame 110. Assembled tent frame 110 supports tent 10 on a support surface 16 and defines an inner space 12 between assembled tent frame 110 and support surface 16. In this example, tent frame 100 includes a plurality of frame poles 114 that are interconnected to form assembled tent frame 110. In particular, assembled tent frame 110 includes a pair of support frames 42 and a roof pole 111 that interconnects support frames 42. Each support frame 42 may include a pair of leg poles 112 having base ends that contact support surface 16 and upper ends that are joined together through a frame pole connector 141. Roof pole 111 also is connected to both frame pole connectors 141 and extends between support frames 42 such that assembled tent frame 110 defines inner space 12. Roof pole 111 includes a laterally extending section 40, which extends approximately parallel to support surface 16, while support frames 42 may be described as defining at least a portion of upwardly extending sections 44 of tent 10.

As shown, tent 10 further includes two clearance poles 130 that are operatively coupled to assembled tent frame 110 via a clearance mechanism 20. More specifically, clearance mechanism 20 includes a connector 140 that is operatively coupled to roof pole 111 proximate and/or along laterally extending section 40. A first clearance pole 130 and a second clearance pole 130 are operatively coupled to connector 140 and extend from connector 140 away from inner space 12 to define outer space 14. Each clearance pole 130 includes a proximal end 32 that is operatively coupled to connector 140, and connector 140 orients proximal ends 32 to extend in an upward direction. Connector 140 also orients clearance poles 130 to extend in opposing radial directions relative to one another, such that the first clearance pole 130 and the second clearance pole 130 define a pair of clearance poles 132.

Clearance mechanism 20 also may include a tensioning structure 30 that may extend between distal ends 34 of pair of clearance poles 132 to tension at least distal ends 34 in the upward direction against one another. Tensioning structure 30 may include a strap, a cord, a wire, a brace or the like. Additionally or alternatively, tensioning structure 30 may be included in an outer tent fabric 120.

With continued reference to FIG. 2, tent 10 may include an outer tent fabric 120. Additionally or alternatively, tent 10 may include an inner tent fabric 122. As shown, outer tent fabric 120 is operatively coupled to, supported by, and/or suspended from at least distal ends 34 of pair of clearance poles 132 and surrounds assembled tent frame 110 and inner space 12. Clearance poles 130 support or suspend at least a portion of outer tent fabric 120 spaced above assembled tent frame 110, such that outer tent fabric 120 also surrounds at least a portion of outer space 14. Outer tent fabric 120 also may be coupled to base regions of assembled tent frame 110.

Outer tent fabric 120 may be operatively coupled to distal ends 34 of pair of clearance poles 132 via pole receivers 124, and clearance poles 130 may tension outer tent fabric 120 to form a ridge of tent 10 and steep sidewalls extending up to the ridge of tent 10. Pair of clearance poles 132 also may tension outer tent fabric 120 to adopt an angular shape, which as discussed herein, may facilitate movement of condensation along the inner surface of outer tent fabric 120 away from inner space 12, and/or may permit outer tent fabric 120 to direct water or snow down and off its outer surface. The tension imparted on outer tent fabric 120 by pair of clearance poles 132 also may stiffen outer tent fabric 120 to benefit the resilience of tent 10 against external forces, such as wind, rain, and snow loading.

Some conventional tents include cantilevered poles, such as eave poles or ridge struts, that are cantilevered from the assembled tent frame and used to support one or more tent fabrics. Generally speaking, the cantilevered poles of conventional tents are coupled to the assembled tent frame to extend laterally or parallel to the support surface. When one or more tent fabrics are attached to the cantilevered poles, the tent fabrics apply a downward force that strains the cantilevered poles to droop and point downwardly relative to the support surface. This drooping often causes a reduction in headspace within the tent and also may reduce the effective height of entranceway to the tent.

As shown in FIG. 2, clearance mechanism 20 orients clearance poles 130 to project upwardly and above assembled tent frame 110, which permits clearance poles 130 to support outer tent fabric 120 spaced above assembled tent frame 110 without drooping, which increases headspace within the tent. Moreover, clearance poles 130, together with clearance mechanism 20, may support outer tent fabric 120 more stably relative to conventional cantilevered poles. More specifically, each clearance pole 130 projects in an upward direction that at least partially opposes gravity and balances the weight of outer tent fabric 120. Additionally, the lateral force applied to each clearance pole 130 is balanced against the other clearance pole 130 due to the convex or V-shape formed by pair of clearance poles 132.

As further shown in the examples of FIG. 2, clearance mechanism 20 orients pair of clearance poles 132 to extend traverse to and above roof pole 111. In this way, each clearance pole 130 extends above and beyond roof pole 111 to increase the height of tent 10 and the breadth or ridge width of tent 10. As such, pair of clearance poles 132 afford tent 10 with a larger or wider floor space and greater headspace, as compared to assembled tent frame 110 alone. When tent 10 includes outer tent fabric 120, outer tent fabric 120 may be supported by pair of clearance poles 132 such that the entranceways, or doorways, of outer tent fabric 120 are positioned proximally below distal ends 34 of pair of clearance poles 132. In this way, the clearance above assembled tent frame 110 offered by each clearance pole 130 also may provide outer tent fabric 120 with a higher entrance, such as to benefit ingress and egress to tent 10.

While FIG. 2 illustrates examples in which each support frame 42 is formed from a pair of leg poles 112, it is within the scope of the present disclosure that each support frame 42 may include a single frame pole 114 that is bent into an arcuate shape, such that both ends of frame pole 114 operatively contact support surface 16. Similarly, while FIG. 2 illustrates examples in which pair of clearance poles 132 includes two clearance poles 130, or has a two clearance pole configuration, it is within the scope of the present disclosure that pair of clearance poles 132 may include a single clearance pole 130 or a single clearance pole configuration. More specifically, in the single clearance pole configuration, connector 140 may operatively couple to a midsection of the single clearance pole 130 such that the single clearance pole 130 includes a pair of distal ends 34 that extend away from inner space 12 to define outer space 14, and tensioning structure 30 may tension at least the pair of distal ends 34 to extend in the upward direction and/or above assembled tent frame 110. The single clearance pole configuration of pair of clearance poles 132 may include substantially the same features and functions, and provide substantially the same benefits, as the two clearance pole configuration of pair of clearance poles 132 that is discussed in detail herein with reference to FIG. 2.

FIG. 3 is a partial cutaway end view of the examples of tent 10 that are represented and discussed herein with reference to FIG. 2. In particular, FIG. 3 illustrates more specific examples of tent 10 including either or both of outer tent fabric 120 and inner tent fabric 122. On the right side of the schematic cutline, tent 10 includes outer tent fabric 120, which is shown in solid lines, and tent 10 optionally includes inner tent fabric 122, which is illustrated in dotted lines. On the left side of the schematic cutline, tent 10 includes inner tent fabric 122, which is shown in solid lines, and tent 10 optionally includes outer tent fabric 120, which is shown in dot-dash lines.

As shown, inner tent fabric 122 is hung from assembled tent frame 110 and is configured to surround at least a portion of inner space 12. In these examples, inner tent fabric 122 also is hung from clearance poles 130. Inner tent fabric 122 may be hung from assembled tent frame 110 and clearance poles 130 in any suitable manner, for example, via straps, clips, hooks, loops, Velcro (e.g., hook and loop) fasteners, and/or combinations thereof. Inner tent fabric 122 may define a living space within tent 10, and clearance poles 130 support inner tent fabric 122 above and outward from roof pole 111. In this way, inner tent fabric 122 may offer a living space with a higher and wider head space and a wider floor space than that which inner tent fabric 122 would offer when hung from assembled tent frame 110 alone.

Outer tent fabric 120 is supported by at least distal ends 34 of each clearance pole 130, and pair of clearance poles 132 tensions outer tent fabric 120 to form the ridge and/or a tensioned ridge of tent 10. As shown, clearance poles 130 support outer tent fabric 120 spaced above at least a portion of assembled tent frame 110. When tent 10 includes both inner tent fabric 122 and outer tent fabric 120, clearance poles 130 support, tension, or suspend outer tent fabric 120 spaced from, or spaced above, at least a portion of inner tent fabric 122 to create a clearance volume 22 therebetween. In particular, clearance poles 130 may support outer tent fabric 120 spaced apart from inner tent fabric 122, at least along the ridge of tent 10.

The clearance volume 22 afforded by clearance poles 130 supporting or suspending outer tent fabric 120 above assembled tent frame 110 and inner tent fabric 122 may offer several advantages over conventional tents, in which the outer tent fabric generally is supported directly upon the assembled tent frame with a small separation from inner tent fabric. More specifically, clearance volume 22 may facilitate airflow between inner tent fabric 122 and outer tent fabric 120 to improve ventilation within tent 10 and prevent moisture or condensation from accumulating within tent 10. Additionally, clearance volume 22 may prevent the transfer of condensation from outer tent fabric 120 to inner tent fabric 122 by preventing contact therebetween.

FIG. 4 is an isometric view illustrating more examples of tents 10 according to the present disclosure. The examples of tent 10 illustrated in FIG. 4 are similar to the examples of tent 10 represented in FIGS. 2-3. More specifically, in FIG. 4 tent 10 includes assembled tent frame 110, which includes support frame 42 formed from a pair of leg poles 112, and a roof pole 111 having one end that is operatively coupled to support frame 42 via frame pole connector 141. However, in the examples of FIG. 4, assembled tent frame 110 includes a single leg pole 112 having an upper end that is operatively coupled to the other end of roof pole 111, such as by frame pole connector 141, and a base end that operatively contacts support surface 16. In this way, assembled tent frame 110 includes three base ends that support tent 10 on support surface 16. While FIG. 4 illustrates examples in which roof pole 111 and leg pole 112 are joined by frame pole connector 141, it is within the scope of the present disclosure that assembled tent frame 110 may include a single frame pole 114 in place of roof pole 111 and leg pole 112 of FIG. 4 that is bent in an arcuate shape to couple to support frame 42 and contact support surface 16.

Tent 10 also includes pair of clearance poles 132 that are operatively coupled to roof pole 111 by connector 140, and connector 140 orients proximal end 32 of each clearance pole 130 to project in the upward direction traverse to roof pole 111. As indicated in dotted lines, tent 10 may include inner tent fabric 122. When included, inner tent fabric 122 may be hung from assembled tent frame 110 along leg pole 112, roof pole 111, and support frame 42. Inner tent fabric 122 also may be operatively coupled to the three base ends of assembled tent frame 110 and to anchors 28 to spread the floor of inner tent fabric 122 into a generally rectangular shape. As shown in FIG. 4, inner tent fabric 122 also is operatively coupled to pair of clearance poles 132, such as distal ends 34 thereof, and each clearance pole 130 upwardly tensions or suspends an upper region of inner tent fabric 122 to be laterally spaced away from roof pole 111 and widen the roof or ridge of inner tent fabric 122. Due to clearance mechanism 20, such as connector 140 and/or tensioning structure 30, supporting and orienting each clearance pole 130 as discussed herein, pair of clearance poles 130 may not droop significantly from the weight of inner tent fabric 122 and may suspend the roof of inner tent fabric 122 in a level manner. Stated more generally, pair of clearance poles 132 may increase the head space and/or living space provided by inner tent fabric 122 without requiring assembled tent frame 110 to include additional frame poles 114. As such, tent 10 may require fewer frame poles 114 and may be lighter than a conventional tent that offers an equivalent space but does not include clearance poles 130.

As indicated in dot-dashed lines, in some examples of FIG. 4, tent 10 includes outer tent fabric 120, which is supported above at least a portion of assembled tent frame 110 by pair of clearance poles 132. When included, outer tent fabric 120 may include tensioning structure 30. When tent 10 includes both of inner tent fabric 122 and outer tent fabric 120, pair of clearance poles 132 create clearance volume 22 between at least a portion of inner tent fabric 122 and outer tent fabric 120, such as to improve ventilation and prevent condensation from forming in tent 10.

Pair of clearance poles 132 also may contribute to the stability of tent 10. For example, as shown in FIG. 4, tent 10 may include anchors 28 that secure base regions of outer tent fabric 120 and/or inner tent fabric 122 to support surface 16. Pair of clearance poles 132 support outer tent fabric 120 spaced laterally away from roof pole 111, and thus provides leverage to outer tent fabric 120 for tensioning tent 10 against support surface 16 via anchors 28.

Turning to FIG. 5, illustrated therein are examples in which tent 10 includes two pairs of clearance poles 132. As shown in FIG. 5, assembled tent frame 110 of tent 10 includes a first support frame 42, a second support frame 42, and a roof pole 111 that interconnects first support frame 42 and second support frame 42. Each support frame 42 includes a pair of leg poles 112, in which each leg pole 122 has a base end that is supported on support surface 16 and an upper end that is operatively coupled to the other leg pole 112 to form a triangular shape. More specifically, leg poles 112 of the first support frame 42 are operatively coupled to one another via a first connector 140, and leg poles 112 of the second support frame 42 are operatively coupled to one another via a second connector 140. A first connector 140 operatively couples one end of roof pole 111 to the first support frame 42, and a second connector 140 operatively couples the other end of roof pole 111 to the second support frame 42.

Further shown in the examples of FIG. 5, tent 10 also includes a first pair of clearance poles 132 that are operatively coupled to assembled tent frame 110 via the first connector 140 and a second pair of clearance poles 132 via the second connector 140. Connectors 140 orient each clearance pole 130 to extend upwardly relative to support surface 16 and away from inner space 12 to define outer space 14. Connectors 140 also orient each clearance pole 130 to project in opposing radial directions relative to one another. Tent 10 also may include outer tent fabric 120 and distal end 34 of each clearance pole 130 may support or suspend outer tent fabric 120, spaced above assembled tent frame 110. Tent 10 further may include inner tent fabric 122, which may be hung from assembled tent frame 110.

FIG. 6 illustrates examples in which tent 10 includes pair of clearance poles 132 and an individual clearance pole 134. More specifically, in the examples of FIG. 6, pair of clearance poles 132 and individual clearance pole 134 are operatively coupled to a common connector 140 and tensioned against one another.

As shown, tent 10 includes assembled tent frame 110 that includes a pair of support frames 42, and a roof pole 111 that extends between and interconnects support frames 42, such as discussed herein with reference to the examples of FIGS. 2-3. Tent 10 also includes clearance mechanism 20 that orients clearance poles 130 and operatively couples clearance poles 130 to assembled tent frame 110. More specifically, clearance mechanism 20 includes connector 140 that operatively couples pair of clearance poles 132 to roof pole 111 and orients proximal end 32 of each clearance pole 130 of pair of clearance poles 132 to extend in a downward direction. Individual clearance pole 134 is operatively coupled to connector 140 between pair of clearance poles 132, and connector 140 orients individual clearance pole 134 to extend upwardly in a vertical, or substantially vertical, direction relative to support surface 16.

Clearance mechanism 20 also includes tensioning structure 30 that may extend between distal ends 34 of pair of clearance poles 132 and individual clearance pole 134. More specifically, tensioning structure 30 tensions distal ends 34 of pair of clearance poles 132 against distal end 34 of individual clearance pole 134, such that distal ends 34 of pair of clearance poles 132 extend in the upward direction relative to support surface 16 and are positioned above proximal ends 32 and roof pole 111. In other words, tensioning structure 30 tensions pair of clearance poles 132 upwardly against individual clearance pole 134. As such, FIG. 6 illustrates examples in which clearance mechanism 20 orients pair of clearance poles 132 to project in the upward direction and extend beyond inner space 12 to create outer space 14, even though connector 140 orients proximal ends 32 of pair of clearance poles 132 to project in the downward direction.

Tensioning structure 30 may include any suitable structure, such as one or more straps, one or more wires, one or more braces, and/or one or more cords. Additionally or alternatively, tensioning structure 30 may be included in outer tent fabric 120.

As shown in FIG. 6, tent 10 may include outer tent fabric 120, and outer tent fabric 120 may be supported on or suspended from distal ends 34 of each clearance pole 130, such that outer tent fabric 120 is supported above at least a portion of assembled tent frame 110. Tent 10 also may include inner tent fabric 122, which may be coupled to assembled tent frame 110 and optionally pair of clearance poles 132.

FIG. 6 also illustrates examples in which each frame pole 114 of assembled tent frame 110 may include a plurality of pole segments 118 that are interconnected to form the respective frame pole 114. Further shown, each clearance pole 130 also may include a plurality of pole segments 118 that are interconnected to form the respective clearance pole 130. Further shown, two or more pole segments 118 may be interconnected by an elastic cord 60. As discussed herein, when tent 10 is disassembled from the assembled state illustrated in FIG. 6 to the disassembled state, pole segments 118 that form frame poles 114 and/or clearance poles 130 may be disengaged from one another but may remain elastically interconnected via elastic cord(s) 60.

Turning to FIG. 7, illustrated therein are examples in which tent 10 includes pair of clearance poles 132 and two individual clearance poles 134, in which a first connector 140 operatively couples pair of clearance poles 132 to assembled tent frame 110 and each individual clearance pole 134 is coupled to assembled tent frame 110 through a separate connector 140.

More specifically, as shown in FIG. 7, tent 10 includes assembled tent frame 110 having a pair of support frames 42 and a roof pole 111 that interconnects the pair of support frames 42. Each support frame 42 includes a pair of leg poles 112 and a connector 140 that operatively couples the upper ends of leg poles 112 to one another. Each individual clearance pole 134 is operatively coupled to a support frame 42 through a connector 140. Connectors 140 may orient proximal ends 32 of individual clearance poles 134 to extend in the upward direction such that individual clearance poles 134 project in the upward direction relative to support surface 16 and extend away from inner space 12 to define outer space 14.

Connectors 140 also operatively couple support frames 42 to either end of roof pole 111, such that roof pole 111 and support frames 42 define inner space 12. Pair of clearance poles 132 are operatively coupled to roof pole 111 proximate and/or along laterally extending section 40 via connector 140, and connector 140 may orient pair of clearance poles 130 to project in the upward direction relative to support surface 16 and away from inner space 12 to define outer space 14.

Tent 10 also may include tensioning structure 30. As shown, tensioning structure 30 may extend between each clearance pole 130 of pair of clearance poles 132. Additionally or alternatively, tensioning structure 30 may extend between each individual clearance pole 134 and one or both clearance poles 130 of pair of clearance poles 132.

Each clearance pole 130 may be oriented by tensioning structure 30 to project in the upward direction. More specifically, tensioning structure 30 may tension pair of clearance poles 132 against one another to project in the upward direction. Tensioning structure 30 also may tension individual clearance poles 134 against pair of clearance poles 132 and/or against one another to project in the upward direction. Additionally or alternatively, tensioning structure 30 may form a tensioned pair between two clearance poles 130 and/or a tensioned network between three or more clearance poles 130. For example, when tensioning structure 30 extends between pair of clearance poles 132, tensioning structure 30 may be described as forming a tensioned pair therebetween that may distribute loads about the ridge of tent 10. When tensioning structure 30 extends between pair of clearance poles 132 and either individual clearance pole 134, tensioning structure 30 may be described as forming a tensioning network that distributes loads about the roof and sides of the tent. Additionally, when tensioning structure 30 extends between both individual clearance poles 134 and pair of clearance poles 132, the tensioned network formed therebetween also may distribute loads about either side of the tent.

Individual clearance poles 134 and/or tensioning structure 30 illustrated and discussed herein with reference to FIG. 7 may be included in the examples of tent 10 illustrated in each of FIGS. 2-6 without departing from the scope of the present invention. Additionally, while FIG. 7 illustrates examples in which tent 10 includes two individual clearance poles 134, tent 10 also may include a single individual clearance pole 134 that may be coupled to a single support frame 42 without departing from the scope of the present invention.

FIG. 8 illustrates examples in which tent 10 includes pair of clearance poles 132, and in which tent 10 may include individual clearance pole 134 and/or one or more auxiliary pairs of clearance poles 136. As shown, tent 10 includes assembled tent frame 110 having pair of support frames 42 that cross over one another proximate and/or along laterally extending sections 40 of support frames 42 and/or proximate an apex 70 of tent 10. Each support frame 42 may include a single frame pole 114, such as a unit pole, and/or may include a roof pole 111 and a pair of leg poles 112 that are interconnected to form support frame 42. Additionally or alternatively, each frame pole 114 included in support frame 42 may include a plurality of interconnected pole segments 118.

Pair of clearance poles 132 is operatively coupled to one or both support frames 42 via connector 140 proximate laterally extending sections 40 and/or apex 70 of tent 10. Connector 140 also may operatively couple the two support frames 42 of assembled tent frame 110 to one another. As shown, connector 140 orients proximal end 32 of each clearance pole 130 of pair of clearance poles 132 to extend in the upward direction, such that pair of clearance poles 132 projects in the upward direction and away from inner space 12 to define outer space 14.

Tent 10 also may include an individual clearance pole 134 that is operatively coupled to connector 140 between pair of clearance poles 132, and connector 140 may orient individual clearance pole 134 to project upwardly in a vertical or substantially vertical direction relative to support surface 16. Additionally or alternatively, tent 10 may include one or more auxiliary pairs of clearance poles 136. As shown, each auxiliary pair of clearance poles 136 includes two clearance poles 130 that are coupled to one another via a clearance pole connector 142, which orients auxiliary pair of clearance poles 136 to form in a V-shape. Each auxiliary pair of clearance poles 136 may be operatively coupled along upwardly extending sections 44 of assembled tent frame 110 via one or more connectors 140, such that each clearance pole 130 of pair of clearance poles 132 projects upwardly relative to support surface 16 and away from inner space 12 to define outer space 14. More specifically, a first connector 140 may operatively couple a first clearance pole 130 of auxiliary pair of clearance poles 136 to a first support frame 42, and a second connector 140 may operatively couple a second clearance pole 130 of auxiliary pair of clearance poles 136 to a second support frame 42.

With continued reference to FIG. 8, tent 10 also may include outer tent fabric 120, and outer tent fabric 120 may be supported spaced apart from, or suspended by, each clearance pole 130. As shown, pair of clearance poles 132, and optionally each individual clearance pole 134, supports or suspends outer tent fabric 120 above assembled tent frame 110 proximate laterally extending section 40 of assembled tent frame 110. When included, auxiliary pair of clearance poles 136 may support or suspend outer tent fabric 120 spaced apart from assembled tent frame 110 proximate upwardly extending sections 44 of assembled tent frame 110. Tent 10 also may include inner tent fabric 122, and each clearance pole 130 may support outer tent fabric 120 spaced apart from inner tent fabric 122 with the clearance volume extending therebetween. As such, auxiliary pair of clearance poles 136 may be described as increasing clearance volume 22 along upwardly extending sections 44 of assembled tent frame 110.

As further shown in FIG. 8, tent 10 also may include tensioning structure 30. Tensioning structure 30 may extend between pair of clearance poles 132 and individual clearance poles 134 to form a tensioned network therebetween and/or to tension pair of clearance poles 132 in the upward direction. Tensioning structure 30 also may extend between auxiliary pair of clearance poles 136, pair of clearance poles 132, and/or individual clearance pole 134. More specifically, tensioning structure 30 may tension at least distal ends 34 of each clearance pole 130 of auxiliary pair of clearance poles 136 to extend in the upward direction and/or may form a tensioned network between pair of clearance poles 132 and/or individual clearance pole 134 and one or more auxiliary pairs of clearance poles 136.

Auxiliary pair of clearance poles 136 also may be included in and/or utilized with any of the examples of tents 10 illustrated in FIGS. 2-7 without departing from the scope of the present disclosure.

FIG. 9 illustrates examples of tent 10 in which clearance poles 130 and clearance mechanism 20 are operatively coupled to assembled tent frame 110 having a single support frame 42. In particular, in the specific examples of FIG. 9, support frame 42 includes a pair of leg poles 112 that define upwardly extending sections 44 of assembled tent frame 110 and a roof pole 111 that interconnects the pair of leg poles 112 and includes laterally extending section 40 of assembled tent frame 110. However, it also is within the scope of the present disclosure that support frame 42 of FIG. 9 may include a single frame pole 114, such as a unit pole.

As shown in FIG. 9, tent 10 also includes pair of clearance poles 132 and connector 140 that operatively couples pair of clearance poles 132 to roof pole 111 and may orient pair of clearance poles 132 to project traverse to roof pole 111. Connector 140 also may orient proximal ends 32 of clearance poles 132 to extend in the upward direction such that pair of clearance poles 132 project in the upward direction relative to support surface 16. Additionally or alternatively, clearance mechanism 20 may include tensioning structure 30, and tensioning structure 30 may extend between clearance poles 130 of pair of clearance poles 132 to tension pair of clearance poles 132 to project in the upward direction.

Tent 10 also may include one or more individual clearance poles 134 and one or more connectors 140 to orient individual clearance poles 134 to project in the upward direction and away from inner space 12 to define outer space 14. In particular, tent 10 may include a first connector 140 that operatively couples a first individual clearance pole 134 to support frame 42 and a second connector 140 that operatively couples a second individual clearance pole 134 to support frame 42. The first connector 140 and the second connector 140 also may operatively couple roof pole 111 to leg poles 112. Tensioning structure 30 may extend between each individual clearance pole 134 and pair of clearance poles 132 such as to form a tensioned network therebetween. As discussed herein, tensioning structure 30 may include one or more straps, one or more wires, one or more braces, and/or cords, and/or tensioning structure 30 may be included in outer tent fabric 120.

As shown in FIG. 9, tent 10 also may include an outer tent fabric 120, and clearance poles 130 may support and/or suspend outer tent fabric 120 spaced apart from assembled tent frame 110. In particular, pair of clearance poles 132 support or suspend outer tent fabric 120 above and laterally spaced from roof pole 111, such as to create a ridge in tent 10 that extends above and traverse to roof pole 111. Tent 10 also may include anchors 28, and outer tent fabric 120 may extend down from distal ends 34 of pair of clearance poles 132 to couple to anchors 28 and support tent 10 upright on support surface 16. Meanwhile, individual clearance poles 134 support or suspend outer tent fabric 120 spaced above end regions of roof pole 111 and away from leg poles 112. In this way, when tent 10 includes outer tent fabric 120, clearance poles 130 support outer tent fabric 120 to have four side walls, or vertically extending sections, that surround inner space 12 and at least a portion of outer space 14, even though assembled tent frame 110 only includes a single support frame 42. Tent 10 also may include inner tent fabric 122, which may be hung from assembled tent frame 110 and optionally pair of clearance poles 132.

Now with reference to FIG. 10, illustrated therein are examples in which tent 10 only includes individual clearance poles 134. In the particular examples shown in FIG. 10, tent 10 includes an assembled tent frame 110 having a pair of support frames 42 and a roof pole 111 that interconnects support frames 42, such that assembled tent frame 110 defines an inner space 12. The general construction of assembled tent frame 110 of FIG. 10 may be similar, or substantially similar, to the assembled tent frames 110 illustrated and discussed herein with reference to FIGS. 2-7. For example, roof pole 111 may be generally linear (as shown) or arcuate (as shown in FIGS. 2-7). Also, one of the support frames 42 illustrated in FIG. 10 may be replaced by a single leg pole 112, such as illustrated in the examples of FIG. 4, without departing from the scope of the present disclosure.

As shown in FIG. 10, tent 10 includes a first individual clearance pole 134 and a second individual clearance pole 134, a first connector 140 that operatively couples the first individual clearance pole 134 to one end of roof pole 111, and a second connector 140 that operatively couples the second individual clearance pole 134 to the other end of roof pole 111. Connectors 140 also operatively couple each pair of leg poles 112 to roof pole 111. Each connector 140 orients proximal end 32 of individual clearance pole 134 to extend in the upward direction relative to support surface 16, such that individual clearance pole 134 projects in the upward direction and away from inner space 12 to define outer space 14.

Connectors 140 also orient individual clearance poles 134 to extend in opposing upward directions relative to one another. As shown, tent 10 may include tensioning structure 30 that extends between the first individual clearance pole 134 and the second individual clearance pole 134, such as distal ends 34 thereof, such as to form a tensioned pair therebetween and distribute loads along the ridge of tent 10. With connectors 140 orienting individual clearance poles 134 to extend in opposing upward directions relative to one another, tensioning structure 30 additionally or alternatively may tension individual clearance poles 134 in the upward direction against one another.

With continued reference to FIG. 10, tent 10 also may include outer tent fabric 120, and tensioning structure 30 may be included in outer tent fabric 120. As shown, individual clearance poles 134 support or suspend at least a portion of outer tent fabric 120 spaced above at least a portion of assembled tent frame 110 such that outer tent fabric 120 surrounds inner space 12 and at least a portion of outer space 14. Additionally, individual clearance poles 134 may support or suspend outer tent fabric 120 outwardly from roof pole 111 and/or support frames 42, such as to create eaves in outer tent fabric 120. Outer tent fabric 120 also may be operatively coupled to base regions of assembled tent frame 110 and/or to support surface 16.

Tent 10 further may include inner tent fabric 122, which may be hung from assembled tent frame 110 and surround at least a portion of inner space 12. When tent 10 includes both inner tent fabric 122 and outer tent fabric 120, individual clearance poles 134 support or suspend outer tent fabric 120 spaced apart from at least a portion of inner tent fabric 122, with clearance volume 22 being formed therebetween.

FIG. 11 illustrates more examples in which tent 10 only includes individual clearance poles 134. In these examples, tent 10 includes assembled tent frame 110 having a first support frame 42 and a second support frame 42 that extends upwardly at intersecting oblique angles from support surface 16. More specifically, support frames 42 are arranged to cross over one another along upwardly extending sections 44 of each support frame 42, and support frames 42 are operatively coupled to one another about the two intersections, such as via frame pole connectors 141. Support frames 42 may include a pair of leg poles 112 and roof pole 111 that extends between and interconnects the upper ends of leg poles 112. Additionally or alternatively, each support frame 42 may include a single frame pole 114, such as a unit pole.

A first individual clearance pole 134 and a second individual clearance pole 134 are operatively coupled to the first support frame 42 via a first connector 140 and a second connector 140, and a third individual clearance pole 134 and a fourth individual clearance pole 134 are operatively coupled to the second support frame 42 via a third connector 140 and a fourth connector 140. As shown in FIG. 11, connectors 140 also may operatively couple roof poles 111 to leg poles 112, with each individual clearance pole 134 being positioned proximate an end of a roof pole 111. Each connector 140 orients a respective individual clearance pole 134 to project upwardly relative to support surface 16 and away from inner space 12 to define outer space 14. In this way, each individual clearance pole 134 points away from assembled tent frame 110 in an opposing direction such that the four individual clearance poles 134 form four upper corners of tent 10.

In some examples, tent 10 includes tensioning structure 30 that extends between two or more individual clearance poles 134. In particular, tensioning structure 30 may extend between individual clearance poles 134 that are operatively coupled to the same support frame 42 and/or may extend between individual clearance poles 134 that are operatively coupled to separate support frames 42.

Tent 10 also may include an outer tent fabric 120, and each individual clearance pole 134 may support or suspend outer tent fabric 120 spaced apart from assembled tent frame 110. Individual clearance poles 134 may tension outer tent fabric 120 to take on an angular or box shape. Additionally or alternatively, outer tent fabric 120 may include tensioning structure 30. Tent 10 also may include inner tent fabric 122, which may be hung from assembled tent frame 110 and optionally one or more individual clearance poles 134.

FIG. 12 illustrates another example in which tent 10 only includes individual clearance poles 134. In these examples, assembled tent frame 110 includes a pair of support frames 42 that cross over one another about laterally extending sections 40, support frames 42 and/or proximate apex 70 of tent 10 to form inner space 12. Each support frame 42 may include a pair of leg poles 112 and a roof pole 111 that extends between and interconnects the upper ends of leg poles 112. Roof pole 111 of each support frame 42 may be operatively coupled to leg poles 112 via connectors 140, and an individual clearance pole 134 may extend from each connector. Additionally or alternatively, each support frame 42 may include a single frame pole 114, such as a unit pole.

As shown, tent 10 includes a plurality of individual clearance poles 134 that are operatively coupled to assembled tent frame 110 through a plurality of connectors 140. More specifically, a first individual clearance pole 134 and a second individual clearance pole 134 are operatively coupled to the first support frame 42, such as on either end of roof pole 111, via a first connector 140 and a second connector 140. A third individual clearance pole 134 and a fourth individual clearance pole 134 are operatively coupled to the second support frame 42, such as on either end of roof pole 111, via a third connector 140 and a fourth connector 140. Tent 10 further includes a fifth individual clearance pole 134 that is operatively coupled to first support frame 42 and/or the second support frame 42 via a fifth connector 140 proximate the intersection of the first support frame 42 and the second support frame 42 and/or proximate apex 70. The fifth connector 140 may operatively couple the first support frame 42 and the second support frame 42 to one another.

With continued reference to FIG. 12, each connector 140 orients a respective individual clearance pole 134 to project upwardly relative to support surface 16 and away from inner space 12 to define outer space 14. More specifically, the first connector 140 and the second connector 140 orient the first individual clearance pole 134 and the second individual clearance pole 134 to project in opposing directions relative to one another, while the third connector 140 and the fourth connector 140 orient the third individual clearance pole 134 and the fourth individual clearance pole 134 to project in opposing directions relative to one another. Meanwhile, the fifth connector 140 orients the fifth clearance pole 134 to project upwardly in a vertical, or substantially vertical, direction relative to support surface 16.

With continued reference to FIG. 12, tent 10 may include tensioning structure 30 that extends between two or more individual clearance poles 134. For example, tensioning structure 30 may extend between the fifth individual clearance pole 134 and one or more of the first, the second, the third, and the fourth individual clearance poles 134, such as to form a tensioned pair or network therebetween and/or to tension one or more of the first, the second, the third, and the fourth individual clearance poles 134 in the upward direction. Additionally or alternatively, tensioning structure 30 may extend between two or more of the first, the second, the third, and the fourth individual clearance poles 134 to form a tensioned network therebetween and distribute loads about the perimeter of tent 10.

As shown in FIG. 12, tent 10 also may include outer tent fabric 120, and outer tent fabric 120 may include tensioning structure 30. Each individual clearance pole 134 may support or suspend outer tent fabric 120 above, and/or be spaced apart from, assembled tent frame 110. Individual clearance poles 134 also may tension outer tent fabric 120 such as to rigidify and reinforce tent 10 and/or to impart an angular geometry on tent 10 that may enhance tent 10 shedding moisture and/or snow. Tent 10 also may include inner tent fabric 122 that may be hung from assembled tent frame 110, and optionally one or more individual clearance poles 134, and individual clearance poles 134 may support outer tent fabric 120 spaced apart from at least a portion, or the entirety of, inner tent fabric 122.

FIG. 13 schematically represents examples of connectors 140 that may be included in and/or utilized with tents 10, according to the present disclosure. As shown, connector 140 includes a body 150 and at least two pole-receiving regions 151. Each pole-receiving region 151 is configured to support and orient frame pole 114 or clearance pole 130, and each pole receiving region 151 includes a pole slot 162 that is configured to receive and operatively couple to frame pole 114 or clearance pole 130. In particular, when connector 140 includes only two pole-receiving regions 151, connector 140 may include a frame pole-receiving region 160 for receiving frame pole 114 and a clearance pole-receiving region 161 for receiving clearance pole 130. Frame pole-receiving region 160 and clearance pole-receiving region 161 may be positioned within body 150 such that connector 140 orients frame pole 114 and clearance pole 130 in a predetermined arrangement.

As discussed herein, pole-receiving regions 151 also may be referred to as cylindrical portions 151, pole sockets 151, pole couplers 151, pole envelopes 151, pole receivers 151, and/or pole housings 151. As shown in FIG. 13, connector 140 may include more than two pole-receiving regions 151, such as at least 3, at least 4, at least 6, at least 8, at most 10, and/or at most 13 pole-receiving regions 151. As specific examples, connector 140 may include at least 2, at least 3, at least 4, and/or at most 6 clearance pole-receiving regions 161. As more specific examples, connector 140 also may include at least 2, at least 3, at least 4, and/or at most 6 frame pole-receiving regions 160. When connector 140 includes a plurality of clearance pole-receiving regions 161, clearance pole-receiving regions 161 may be positioned along or within body 150 to orient a plurality of clearance poles 130 relative to one another and/or relative to frame pole-receiving region(s) 160 in a predetermined arrangement. As an example, connector 140 may include two clearance pole-receiving regions 161 that are configured to orient pair of clearance poles 132 relative to one another and/or relative to one or more frame poles 114, such as discussed herein. These clearance pole-receiving regions 161 may be referred to as pair of clearance pole-receiving regions 172, such as shown in FIGS. 14-15 and 17. Additionally or alternatively, connector 140 may include a clearance pole-receiving region 161 that is configured to receive and orient individual clearance pole 134, and this clearance pole-receiving region 161 may be referred to herein as an individual clearance pole-receiving region 174, such as shown in FIGS. 16-17.

Similarly, when connector 140 includes a plurality of frame pole-receiving regions 160, frame pole-receiving regions 160 may be disposed along or within body 150 to orient frame poles 114 relative to one another to define a shape of tent 10 and/or relative to one or more clearance poles 130. That said, clearance pole-receiving regions 161 and frame pole-receiving regions 160 may be symmetrically disposed about body 150 such that frame pole-receiving regions 160 may be used for receiving clearance poles 130 and vice versa, with connector 140 still being configured to orient clearance poles 130 and frame poles 114 in the predetermined arrangement.

Each pole-receiving region 151 also may be configured to receive a pole segment 118 of frame pole 114 or clearance pole 130. For example, connector 140 may include a pair of substantially collinear frame pole-receiving regions 160 that receive pole segments 118 of a single frame pole.

Connector 140 may be formed in any suitable shape, and pole-receiving regions 151 may extend along, within and/or from body 150 in any suitable manner. As examples, connector 140 may be spherical, box-shaped, cylindrical, and/or hub-shaped. Pole-receiving regions 151 may extend within body 150 and/or pole-receiving regions 151 may form protrusions that extend outwardly from body 150. Additionally or alternatively, body 150 may comprise a plurality of socket-shaped members that are fixed together in a predetermined arrangement to define a plurality of pole-receiving regions 151. Connector 140 and/or pole-receiving regions 151 may be formed from any suitable one or more materials, such as one or more of aluminum or another metal or alloy, fiberglass, carbon fiber, a polymer, a polymeric material, and/or a plastic.

With continued reference to FIG. 13, each pole slot 162 may be configured to operatively couple to frame pole 114 or clearance pole 130 in any suitable manner and may receive any suitable region of frame pole 114 or clearance pole 130. For example, a proximal end of frame pole 114 or clearance pole 130 may be inserted into pole slot 162 to be secured therein. Alternatively, frame pole 114 or clearance pole 130 may be inserted laterally into pole slot 162, such that pole slot 162 operatively couples to and secures a midsection of frame pole 114 or clearance pole 130 therein. As another example, pole slot 162 may define an aperture or passageway through which clearance pole 130 or frame pole 114 may be slid until connector 140 is placed at a desired position along clearance pole 130 or frame pole 114. As discussed herein, pole slots 162 also may be referred to as insert holes 162, pole notches 162, and/or pole wells 162.

Each pole-receiving region 151 may be configured to selectively and fixedly couple to, or pivotally couple to, clearance pole 130 or frame pole 114. Additionally or alternatively, each pole-receiving region 151 may be configured to repeatedly couple to and uncouple from clearance pole 130 or frame pole 114. For example, when pole slot 162 is configured to receive a proximal end of frame pole 114 or clearance pole 130, frame pole 114 or clearance pole 130 may be at least partially telescoping from pole slot 162. As a more specific example, clearance pole 130 or frame pole 114 may include an elastic cord 60 that extends within frame pole 114 or clearance pole 130. As shown in FIG. 13, each pole-receiving region 151 and/or each pole slot 162 may include an elastic cord receiver 186 that is configured to receive elastic cord 60. Elastic cord 60, together with elastic cord receiver 186, may at least partially interconnect clearance pole 130 or frame pole 114 to connector 140 when clearance pole 130 or frame pole 114 is selectively decoupled from or removed from pole slot 162. Elastic cord 60, together with elastic cord receiver 186, also may urge clearance pole 130 or frame pole 114 to remain within pole slot 162 when pole slot 162 receives clearance pole 130 or frame pole 114. Two or more pole slots 162 may be interconnected. For example, elastic cord receivers 186 of two or more pole slots 162 may form a passageway between two or more pole slots 162, and an elastic cord 60 may extend through the passageway to elastically interconnect two clearance poles 130, two frame poles, or a frame pole 114 and a clearance pole 130.

As further shown in FIG. 13, each pole-receiving region 151 may include a pole retainer 184 that is configured to selectively secure clearance pole 130 or frame pole 114 within pole slot 162. As examples, pole retainer 184 may include a latch, a friction fit, a press fit, a button clip, and/or a threaded insert. When pole-receiving region 151 includes a pole retainer 184, one or more frame poles 114 and/or one or more clearance poles 130 may include a corresponding structure or mechanism for coupling with pole retainer 184. When included, pole retainer 184 may be configured to engage with any suitable portion of clearance pole 130 or frame pole 114. For example, pole retainer 184 may engage with the proximal end of clearance pole 130 or frame pole 114. As a more specific example, pole retainer 184 may engage with a midsection of frame pole 114 or clearance pole 130 and may include a threaded insert or a latch that engages with the midsection of frame pole 114 or clearance pole 130.

Additionally or alternatively, each pole slot 162 may include a pole stop 156 that is configured to support or retain frame pole 114 or clearance pole 130 at a predetermined position within pole slot 162. For example, when pole slot 162 is configured to receive the proximal end of clearance pole 130 or frame pole 114, pole stop 156 may include a ledge, a wall, or a stop ring that supports the proximal end of clearance pole 130 or frame pole 114 within pole slot 162. As discussed herein, two pole slots 162 may be interconnected via a passageway, and pole stop 156, such as a stop ring, may be positioned within the passageway and configured to support the proximal ends of clearance poles 130 or frame poles 114 that are received in either pole slot 162.

As discussed herein, in some examples, tent 10 includes one or more frame pole connectors 141 that are configured to operatively couple frame poles 114 to one another and do not couple to clearance poles 130. FIG. 13 schematically represents examples of frame pole connectors 141 that may be utilized in tent 10. As shown, frame pole connector 141 may include similar or substantially similar components, features, and functions, as discussed herein for connector 140, but frame pole connector 141 only comprises frame pole-receiving regions 160 for receiving frame poles 114 and does not include clearance pole-receiving regions 161. Frame pole connector 141 may include any suitable number of frame pole-receiving regions 160, such as at least 2, at least 3, at least 4, and/or at most 6 frame pole-receiving regions 160.

As discussed herein, tent 10 additionally or alternatively may include one or more clearance pole connectors 142 that are configured to operatively couple one or more clearance poles 130 to one another and do not operatively couple to frame poles 114. FIG. 13 schematically represents examples of clearance pole connectors 142 that may be utilized in tent 10. As shown, clearance pole connectors may include similar or substantially similar components, features, and functions, as discussed herein for connector 140, but clearance pole connector 142 only comprises clearance pole-receiving regions 161 for receiving clearance poles 130 and does not include frame pole-receiving regions 160. Clearance pole connector 142 may include any suitable number of clearance pole-receiving regions 161, such as at least 2, at least 3, at least 4, and/or at most 6 frame pole-receiving regions 160.

Turning now to FIGS. 14-21, illustrative non-exclusive examples of connectors 140 that may be included in tents 10 are illustrated. Where appropriate, the reference numerals from the schematic illustration of FIG. 13 are used to designate corresponding parts of the examples of FIGS. 14-21. However, the examples of FIGS. 14-21 are nonexclusive and do not limit connectors 140 to the illustrated embodiments of FIGS. 14-21. That is, connectors 140 are not limited to the specific embodiments FIGS. 14-21, and connectors 140 may incorporate any number of the various aspects, configurations, characteristics, properties, etc. of connectors 140 that are illustrated in and discussed with reference to the schematic representation of FIG. 13 and/or the embodiments of FIGS. 14-21, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to the examples of FIGS. 14-21; however, it is within the scope of the present disclosure that the previously discussed features, variants, etc. may be utilized with the examples of FIGS. 14-21.

FIG. 14 is an exploded view illustrating somewhat less schematic examples of connectors 140 that may be included in tents 10, according to the present disclosure. More specifically, FIG. 14 illustrates examples in which connector 140 is configured to operatively couple to and orient two clearance poles 130 and two frame poles 114. As shown, connector 140 includes body 150 and a plurality of pole-receiving regions 151 formed along and/or within body 150, with each pole-receiving region 151 including a pole slot 162. In particular, connector 140 includes two clearance pole-receiving regions 161 that each are configured to receive and orient a clearance pole 130, such as a proximal end 32 thereof, and two frame pole-receiving regions 160 that each are configured to receive and orient a frame pole 114, such as a proximal end thereof.

In these particular examples, connector 140 may be described as a hub-style connector 140, with body 150 being formed in a generally cylindrical shape. Each clearance pole 130 and each frame pole 114 is illustrated as being removed from the respective pole slot 162 and at least partially disconnected from connector 140. However, each clearance pole 130 and each frame pole 114 may remain elastically interconnected to connector 140 while removed from pole slot 162. More specifically, each clearance pole 130 and each frame pole 114 may include an elastic cord 60, and each pole-receiving region 151 may include an elastic cord receiver 186 that is configured to receive elastic cord 60. Each elastic cord 60 may be secured to elastic cord receiver 186 to elastically connect frame pole 114 or clearance pole 130 to connector 140. Additionally or alternatively, elastic cord receivers 186 of two or more pole-receiving regions 151 may be interconnected and elastic cord 60 may extend between two or more pole-receiving regions 151 to elastically interconnect frame poles 114, clearance poles 130 and/or combinations thereof.

With continued reference to FIG. 14, each pole-receiving region 151 may define a particular orientation of the respective clearance pole 130 or frame pole 114. For example, each clearance pole-receiving region 161 may be configured to orient clearance pole 130 and/or proximal end 32 thereof, to extend upwardly relative to the support surface and/or outwardly from the inner space at least partially defined by frame poles 114 when connector 140 couples clearance pole 130 to assembled tent frame 110. With this in mind, and as discussed herein, each clearance pole-receiving region 161 may be configured to orient clearance pole 130 to project with any suitable clearance angle relative to the support surface, when connector 140 operatively couples clearance pole 130 to the assembled tent frame 110. As examples, each clearance pole-receiving region 161 may be configured to orient clearance pole 130 to project with a clearance angle of at least 2°, at least 4°, at least 6°, at least 10°, at least 20°, at least 40°, at most 60°, at most 80°, and/or at most 90°.

As shown, clearance pole-receiving regions 161 may be configured to support and orient pair of clearance poles 132, such that, as discussed herein, pair of clearance poles 132 form a clearance pair angle therebetween. Thus, clearance pole-receiving regions 161 may define pair of clearance pole-receiving regions 172. As examples, clearance pole-receiving regions 161 may orient pair of clearance poles 132 with a clearance pair angle of at least 80°, at least 90°, at least 100°, at least 130°, at least 140°, at most 150°, at most 160°, at most 165°, at most 170°, and/or at most 175°. Each frame pole-receiving region 160 may be configured to support and orient frame poles 114 with any suitable angle relative to one another, such as to determine a shape of the tent.

Additionally or alternatively, each frame pole-receiving region 160 may be configured to orient frame pole 114 with any suitable angle relative to each clearance pole 130 and/or a plane formed between clearance poles 130.

The examples of connector 140 that are illustrated in FIG. 14 may be included in and/or utilized with any of the examples of tent 10 that are illustrated and described herein with reference to FIGS. 2-12. As specific examples, the examples of connector 140 of FIG. 14 may operatively couple pair of clearance poles 132 to roof pole 111 in at least any of FIGS. 2-3, FIG. 7, and FIG. 9.

FIG. 15 provides another somewhat less schematic example of connector 140 that is configured to receive pair of clearance poles 132 and roof pole 111. As shown, connector 140 includes clearance pole-receiving regions 161 having pole slots 162 that receive proximal ends 32 of clearance poles 130. Connector 140 also includes one or more frame pole-receiving regions 160 for receiving one or more frame poles 114. More specifically, connector 140 may include a pair of substantially collinear frame pole-receiving regions 160 that are separated by a pole stop 156 and that each are configured to receive a pole segment 118 of a frame pole 114. Alternatively, connector 140 may include single frame pole-receiving region 160 having a pole slot 162 that is configured to be slid onto frame pole 114.

Clearance pole-receiving regions 161 orient proximal ends 32 of clearance poles 130 to extend upwardly and traverse relative to frame pole 114. Clearance pole-receiving regions 161 also orient clearance poles 130 to project in opposing directions relative to one another, such that clearance poles 130 define pair of clearance poles 132. In other words, clearance pole-receiving regions 161 may be described as a pair of clearance pole-receiving regions 172 configured to orient pair of clearance poles 132. Clearance pole-receiving regions 161 also may include elastic cord receivers 186, and an elastic cord 60 may extend through elastic cord receivers 186 to elastically interconnect pair of clearance poles 132.

With continued reference to FIG. 15, connector 140 may include reinforcing bodies 155 that may extend between one or more pole-receiving regions 151. Reinforcing bodies 155 may provide additional support for retaining clearance poles 130 in the upward direction. Each frame pole-receiving region 160 may include pole retainer 184 that is configured to secure frame pole 114 within pole slot 162. In particular, when connector 140 includes a single frame pole-receiving region 160 that is slid onto frame pole 114, pole retainer 184 may be configured to prevent frame pole 114 from translating or rotating within pole slot 162 once connector 140 has been positioned at a desired location along frame pole 114.

The examples of connector 140 of FIG. 15 may be included in and/or utilized with any of the examples of tent 10 illustrated and discussed herein with reference to FIGS. 2-6 in which connector 140 operatively couples pair of clearance poles 132 to frame pole 114. As specific examples, the examples of connector 140 of FIG. 15 may operatively couple pair of clearance poles 132 to roof pole 111 in at least any of FIGS. 2-3, FIGS. 7, and 9.

FIG. 16 illustrates examples in which connector 140 is configured to operatively couple pair of clearance poles 132 and individual clearance pole 134 to assembled tent frame 110. As shown, connector 140 includes three clearance pole-receiving regions 161. More specifically, connector 140 includes pair of clearance pole-receiving regions 172 for receiving pair of clearance poles 132 and individual clearance pole-receiving region 174 for receiving individual clearance pole 134. Connector 140 also includes frame pole-receiving region 160 which may be configured to receive any suitable frame pole 114 of assembled tent frame 110, such as a roof pole 111.

In the examples of FIG. 16, pair of clearance pole-receiving regions 172 are configured to orient proximal ends 32 of pair of clearance poles 132 to project downwardly, and individual clearance pole-receiving region 174 is configured to orient individual clearance pole 134 to project in a vertical, or substantially vertical, direction relative to the support surface, assembled tent frame, and/or roof pole 111.

Each clearance pole-receiving region 161 may be positioned within body 150 above frame pole-receiving region 160, and individual clearance pole-receiving region 174 may be positioned within body 150 above pair of clearance pole-receiving regions 172. Connector 140 further may include reinforcing bodies 155, which may extend between frame pole-receiving region 160 and pair of clearance pole-receiving regions 172 and/or between individual clearance pole-receiving region 174 and pair of clearance pole-receiving regions 172.

The examples of connector 140 illustrated in FIG. 16 may be included in and/or utilized at least with the examples of tent 10 that are illustrated and discussed herein with reference to FIG. 6.

Turning to FIG. 17, illustrated therein are examples in which connector 140 is configured to operatively couple one or more clearance poles 130 to a pair of frame poles 114. In particular, connector 140 includes a pair of frame pole-receiving regions 160, in which each frame pole-receiving region 160 is configured to receive a separate frame pole 114. Frame pole-receiving regions 160 may be disposed along or formed within body 150 in any suitable manner. For example, frame pole-receiving regions 160 may include vertically staggered pole slots 162. As shown in FIG. 17, frame pole-receiving regions 160 may orient frame poles 114 to extend traverse to one another, such that frame poles 114 cross over at connector 140. Frame pole-receiving regions 160 may operatively couple to any suitable combination of frame poles 114 and/or to any suitable region of assembled tent frame 110. As examples, frame pole-receiving regions 160 may operatively couple two support frames 42, may couple two roof poles 111, and/or two unit poles.

With continued reference to FIG. 17, connector 140 may include pair of clearance pole-receiving regions 172 that are configured to operatively couple to and orient pair of clearance poles 132. In particular, the pair of clearance pole-receiving regions 172 may orient pair of clearance poles 132 to project in opposing upward directions relative to one another, traverse to frame poles 114, upwardly relative to support surface 16, and/or upwardly relative to assembled tent frame 110. Additionally or alternatively, connector 140 may include individual clearance pole-receiving region 174 that is configured to orient individual clearance pole 134 vertically, or substantially vertically, relative to support surface 16, relative to frame poles 114, and/or relative to laterally extending section 40 of assembled tent frame 110. When connector 140 includes pair of clearance pole-receiving regions 172 and individual clearance pole-receiving region 174, individual clearance pole-receiving region 174 may be positioned between and/or above pair of clearance pole-receiving regions 172.

Connector 140 also may include reinforcing bodies 155 that extend between two or more pole-receiving regions 151. Additionally or alternatively, each pole-receiving region 151 may include elastic cord receiver 186 and/or pole stop 156, as discussed herein.

The examples of connector 140 shown in FIG. 17 may include either or both of individual clearance pole-receiving region 174 and pair of clearance pole-receiving regions 172. For example, when connector 140 includes pair of clearance pole-receiving regions 172, connector 140 may be included in and/or utilized at least with the examples of tents 10 illustrated and discussed herein with reference to FIG. 8. As another example, when connector 140 only includes individual clearance pole-receiving region 174, connector 140 may be included in and/or utilized with at least the examples of tents 10 illustrated and discussed herein with reference to FIG. 12.

Now with reference to FIG. 18, illustrated therein are examples in which connector 140 is configured to operatively couple an individual clearance pole 134 with two frame poles 114. As shown, connector 140 includes two frame pole-receiving regions 160 that are configured to operatively couple frame poles 114 to one another and may orient frame poles 114 to extend from connector 140 at an oblique angle relative to one another. As an example, connector 140 may be configured to operatively couple roof pole 111 to leg pole 112.

Connector 140 also includes clearance pole-receiving region 161 that is configured to receive and orient individual clearance pole 134 to extend outwardly or away from frame poles 114. As shown, clearance pole-receiving region 161 may orient individual clearance pole 134 to extend along a plane formed by frame poles 114, and connector 140 may orient each frame pole 114 and individual clearance pole 134 to extend away from connector 140 with any suitable angle relative to one another. As a more specific example, when connector 140 receives roof pole 111 and leg pole 112 within assembled tent frame 110, frame pole-receiving regions 160 may orient leg pole 112 to project downwardly or generally towards the support surface and orient roof pole 111 to project upwardly and laterally relative to the support surface. Meanwhile, clearance pole-receiving region 161 may orient individual clearance pole 134 to project outwardly from the angle formed by leg pole 112 and roof pole 111 and upwardly with a predetermined clearance angle relative to the support surface.

Connector 140 also may include reinforcing bodies 155 that may extend between two or more pole-receiving regions 151. Additionally or alternatively, each pole-receiving region 151 may include elastic cord receiver 186 and/or pole stop 156, as discussed herein.

The examples of connector 140 illustrated and discussed herein with reference to FIG. 18 may be utilized with and/or included in any of the examples of tent 10 discussed herein in which connector 140 operatively couples individual clearance pole 134 to a pair of frame poles 114. As examples, connector 140 of FIG. 18 may be utilized to operatively couple individual clearance poles 134 to roof pole 111 and leg poles 112 in the examples of tent 10 illustrated and discussed herein with reference to FIGS. 9, 11, and 12.

FIG. 18 also illustrates examples in which connector 140 is configured to receive three frame poles 114 and may be utilized as a three-way frame pole connector 141. Depending on the particular location, frame pole connector 141 is configured to be positioned within assembled tent frame 110 and/or the particular set of frame poles 114 that frame pole connector 141 is configured to operatively couple. Frame pole connector 141 may orient frame poles 114 with different angles relative to one another than that illustrated for connector 140 in FIG. 18. As an example, the three-way frame pole connector 141 may be utilized to couple the pair of leg poles 112 to roof pole 111 in at least any of the examples of tent 10 that are illustrated in FIGS. 2, 3, and 6.

FIG. 19 illustrates examples in which connector 140 is configured to operatively couple a midsection of clearance pole 130 to frame pole 114. In particular, connector 140 includes frame pole-receiving region 160 having pole slot 162 that is configured to be received onto frame pole 114, such as by sliding onto frame pole 114 and/or being inserted laterally onto frame pole 114. Frame pole-receiving region 160 may include a pole retainer 184 that is configured to selectively retain frame pole 114 within pole slot 162 and/or prevent frame pole 114 from sliding or rotating within pole slot 162. As shown, pole retainer 184 may include a friction fit and/or a threaded insert that is threaded against frame pole 114 to retain frame pole 114 within pole slot 162.

Connector 140 also includes clearance pole-receiving region 161 that is positioned within body 150 above frame pole-receiving region 160 and is configured to orient clearance pole 130 to extend from connector 140 with any suitable angle relative to frame pole 114, such as traverse to and/or perpendicular to frame pole 114. Clearance pole-receiving region 161 includes pole slot 162 that is configured to receive a midsection of clearance pole 130. In particular, pole slot 162 may include a groove and/or a semi-cylindrical recess that is configured to be slid onto clearance pole 130 and/or inserted laterally onto clearance pole 130. Clearance pole-receiving region 161 also may include pole retainer 184 that is configured to retain clearance pole 130 within pole slot 162. As an example, pole retainer 184 may include a latch that is selectively secured over clearance pole 130 to retain clearance pole 130 within pole slot 162 and/or to prevent clearance pole 130 from sliding or rotating within pole slot 162. Pole retainer 184 additionally or alternatively may selectively engage with and secure clearance pole 130 via a friction fit.

The examples of connector 140 that are illustrated in FIG. 19 may be utilized to operatively couple any suitable clearance pole 130 to any suitable frame pole 114 within tent 10. For example, connector 140 may operatively couple a single clearance pole 130 to a frame pole 114 of assembled tent frame 110 such that clearance pole 130 extends away from connector 140 to define pair of clearance poles 132, such as discussed herein. In such a configuration, connector 140 of FIG. 19 may be included in and/or utilized with at least the examples of tent 10 that are illustrated in any of FIGS. 2-4, 7, and 9 to couple pair of clearance poles 132 to roof pole 111. Additionally or alternatively, connector 140 of FIG. 19 may be included in and/or utilized with at least the examples of tent 10 illustrated in FIG. 8 as the connector 140 that operatively couples auxiliary pairs of clearance poles 136 to assembled tent frame 110.

FIG. 19 also illustrates examples in which connector 140 is configured to operatively couple two frame poles 114 to one another and may be utilized as a frame pole connector 141. In such examples, both pole-receiving regions 151 are frame pole-receiving regions 160. As an example, frame pole connector 141 of FIG. 19 may be included in and/or utilized with at least the examples of tent 10 of FIG. 11 to operatively couple support frames 42 to one another.

Turning to FIG. 20, illustrated therein is an example of connector 140 that is configured to operatively couple individual clearance pole 134 to roof pole 111 and a pair of leg poles 112. As shown, connector 140 includes a first frame pole-receiving region 160 and a second frame pole-receiving region 160 that are configured to receive a pair of leg poles 112 and orient the pair of leg poles 112 to extend downwardly towards the support surface. The first frame pole-receiving region 160 and the second frame pole-receiving region 160 also are configured to orient the pair of frame poles 114 to extend in opposing directions relative to one another with a predetermined angle being formed therebetween. Connector 140 also includes a third frame pole-receiving region 160 that is configured to receive a roof pole 111 and orient roof pole 111 to extend traverse to a plane formed by the pair of leg poles 112. The third frame pole-receiving region 160 may be configured to orient roof pole 111 to extend substantially parallel to the support surface or may orient at least a proximal end of roof pole 111 to extend upwardly relative to the support surface.

With continued reference to FIG. 20, connector 140 further includes clearance pole-receiving region 161 that is configured to receive proximal end 32 of individual clearance pole 134 and orient individual clearance pole 134 to extend away from assembled tent frame 110 and upwardly relative to the support surface. In particular, clearance pole-receiving region 161 may orient individual clearance pole 134 to extend traverse to a plane formed by the pair of leg poles 112 and in an opposing direction relative to roof pole 111.

Connector 140 also may include reinforcing bodies 155 that may extend between two or more pole-receiving regions 151. Additionally or alternatively, each pole-receiving region 151 may include elastic cord receiver 186 and/or pole stop 156, as discussed herein.

The examples of connector 140 of FIG. 20 may be utilized with any of the examples of tent 10 that are illustrated and discussed herein with reference to FIGS. 2-12 in which connector 140 operatively couples individual clearance pole 134 to pair of leg poles 112 and roof pole 111. As examples, connector 140 of FIG. 20 may be included in and/or utilized with at least the examples of tent 10 of FIGS. 7 and 10 to operatively couple individual clearance pole 134 to the pair of leg poles 112 and roof pole 111.

FIG. 21 illustrates examples in which connector 140 is configured to operatively couple pair of clearance poles 132 to a pair of leg poles 112 and roof pole 111. In particular, connector 140 includes a first frame pole-receiving region 160 and a second frame pole-receiving region 160 that are configured to receive and orient the pair of leg poles 112, and a third frame pole-receiving region 160 that is configured to receive and orient roof pole 111. Frame pole-receiving regions 160 may orient leg poles 112 and roof pole 111 similarly to the frame pole-receiving regions 160 discussed herein with reference to FIG. 20.

Connector 140 further includes two clearance pole-receiving regions 161, each being configured to receive proximal end 32 of clearance pole 130 and orient clearance pole 130 to project away from assembled tent frame 110 and upwardly relative to the support surface. In particular, clearance pole-receiving regions 161 define pair of clearance pole-receiving regions 172 configured to orient pair of clearance poles 132 to extend from connector 140 in opposing upward directions relative to one another. As shown, clearance pole-receiving regions 161 may be formed within body 150 between the third frame pole-receiving region 160 that receives roof pole 111 and the first and second frame pole-receiving regions 160 that receive leg poles 112. In this way, clearance pole-receiving regions 161 may orient clearance poles 130 to extend upwardly and away from a curvature of assembled tent frame 110 defined by leg poles 112 and roof pole 111.

Connector 140 also may include reinforcing bodies 155 that extend between two or more pole-receiving regions 151. Additionally or alternatively, each pole-receiving region 151 may include elastic cord receiver 186 and/or pole stop 156, as discussed herein.

The examples of connector 140 illustrated in FIG. 21 may be utilized with and/or included in at least any of the examples of tent 10 that are illustrated and discussed herein with reference to FIGS. 2-12. For example, connector 140 of FIG. 21 may be utilized as the connector 140 in at least the examples of FIG. 5.

The tents 10 described and illustrated herein are not limited to the configuration and method of the embodiments described above, and some or all of the embodiments may be selectively combined to make various modifications thereto. Examples of tents according to the present disclosure are presented in the following enumerated paragraphs.

A1. A tent (10), comprising:

a tent frame (100) that, when assembled, forms an assembled tent frame (110) that is configured to support the tent (10) on a support surface (16) and define an inner space (12) between the assembled tent frame (110) and the support surface (16);

at least one clearance pole (130) that, when operatively coupled to the assembled tent frame (110), extends away from the inner space (12) to define an outer space (14); and a clearance mechanism (20) that is configured to operatively couple the at least one clearance pole (130) to the assembled tent frame (110) and orient the at least one clearance pole (130) to project in an upward direction relative to the support surface (16), wherein the clearance mechanism (20) includes a connector (140) that is configured to operatively couple the at least one clearance pole (130) to the tent frame (100).

A1.1 The tent (10) of paragraph A1, wherein the clearance mechanism (20) is configured to orient at least a distal end (34) of the at least one clearance pole (130) to project in the upward direction.

A1.2 The tent (10) of any of paragraphs A1-A1.1 wherein the clearance mechanism (20) is configured to orient a substantial portion of the at least one clearance pole (130) to extend in the upward direction.

A1.3 The tent (10) of any of paragraphs A1-A1.2, wherein the clearance mechanism (20) is configured to orient the entirety of the at least one clearance pole (130) to extend in the upward direction.

A1.4 The tent (10) of any of paragraphs A1-A1.3, wherein the clearance mechanism (20) is configured to orient the at least one clearance pole (130) with a/the distal end (34) of the at least one clearance pole (130) positioned further from support surface (16) than a proximal end (32) of the at least one clearance pole (130).

A1.5 The tent (10) of any of paragraphs A1-A1.4, wherein the clearance mechanism (20) is configured to orient at least a proximal end (32) of the at least one clearance pole (130) to extend in the upward direction.

A2. The tent (10) of any of paragraphs A1-A1.5, wherein the connector (140) is configured to operatively couple to a/the proximal end (32) of the at least one clearance pole (130), and wherein the connector (140) is configured to orient the proximal end (32) of the at least one clearance pole (130) to extend in the upward direction when the connector (140) operatively couples the at least one clearance pole (130) to the assembled tent frame (110).

A3. The tent (10) of any of paragraphs A1-A2, wherein the clearance mechanism (20) includes a tensioning structure (30) that operatively couples to at least a/the distal end (34) of the at least one clearance pole (130) and at least one other portion of the tent (10), and wherein the tensioning structure (30) is configured to tension at least the distal end (34) of the at least one clearance pole (130) in the upward direction when the at least one clearance pole is operatively coupled to the assembled tent frame (110).

A3.1. The tent (10) of paragraph A3, wherein the tensioning structure (30) includes a cord (60) that operatively couples the distal end (34) of the at least one clearance pole (130) and the at least one other portion of the tent (10).

A4. The tent (10) of any of paragraphs A1-A3.1, further comprising an inner tent fabric (122) that is configured to be operatively coupled to the assembled tent frame (110) and surround at least a portion of the inner space (12).

A5. The tent (10) of paragraph A4, wherein the inner tent fabric (122) further is configured to be coupled to the at least one clearance pole (130), and wherein the at least one clearance pole (130) is configured to support a portion of the inner tent fabric (122) when the at least one clearance pole (130) is operatively coupled to the assembled tent frame (110).

A6. The tent (10) of any of paragraphs A4-A5, wherein the inner tent fabric (122) is configured to be hung from the assembled tent frame (110).

A6.1 The tent (10) of any of paragraphs A1-A6, wherein the inner tent fabric (122) is configured to be hung from the at least one clearance pole (130).

A7. The tent (10) of any of paragraphs A1-A6.1, further comprising an outer tent fabric (120), wherein the at least one clearance pole (130) is configured to operatively support the outer tent fabric (120) when the at least one clearance pole (130) is operatively coupled to the assembled tent frame (110), and wherein the outer tent fabric (120) surrounds at least a portion of the outer space (14) when supported by the at least one clearance pole (130).

A8. The tent (10) of paragraph A7, wherein the outer tent fabric (120) is configured to surround at least a portion of the assembled tent frame (110).

A8.1. The tent (10) of any of paragraphs A7-A8, wherein the outer tent fabric (120) is configured to surround the entire assembled tent frame (110).

A9. The tent (10) of any of paragraphs A7-A8.1, wherein the outer tent fabric (120) includes a/the tensioning structure (30).

A10. The tent (10) of any of paragraphs A7-A9, wherein the outer tent fabric (120) includes one or more pole receivers (124), wherein at least one pole receiver (124) of the one or more pole receivers (124) is configured to receive a/the distal end (34) of the at least one clearance pole (130), and wherein the at least one pole receiver (124) defines a portion of a/the tensioning structure (30).

A11. The tent (10) of any of paragraphs A4-A10, wherein the at least one clearance pole (130) is configured to support at least a portion of a/the outer tent fabric (120) spaced apart from the inner tent fabric (122) to form a clearance volume (22) therebetween.

A12. The tent (10) of any of paragraphs A1-A11, wherein the connector (140) is configured to selectively receive the at least one clearance pole (130) and at least one frame pole (114) of the tent frame (100), wherein the connector (140) is configured to orient the at least one clearance pole (130) and the at least one frame pole (114) of the tent frame relative to one another in a predetermined arrangement.

A13. The tent (10) of paragraph A12, wherein the connector (140) is configured to receive a plurality of frame poles (114) and orient the at least one clearance pole (130) and the plurality of frame poles (114) relative to one another in the predetermined arrangement.

A14. The tent (10) of any of paragraphs A12-A13, wherein the tent includes a plurality of clearance poles (130), wherein the connector (140) is configured to receive the plurality of clearance poles (130), and wherein the connector is configured to orient the plurality of clearance poles (130) and the at least one frame pole (114) relative to one another in the predetermined arrangement.

A15. The tent (10) of any of paragraphs A12-A14, wherein the connector (140) includes a body (150) and a plurality of pole-receiving regions (151) formed within the body (150), wherein each pole-receiving region (151) includes a pole slot (162) that is configured to receive one of a frame pole (114) and a clearance pole (130).

A16. The tent (10) of paragraph A15, wherein the plurality of pole-receiving regions (151) are formed within the body (150) to orient the at least one clearance pole (130) and the at least one frame pole (114) in a/the predetermined arrangement.

A17. The tent (10) of any of paragraphs A15-A16, wherein at least one pole-receiving region (151) includes a pole retainer (184) that is configured to selectively and operatively retain one of the frame pole (114) and the at least one clearance pole (130) within the respective pole slot (162).

A18. The tent (10) of any of paragraphs A15-A17, wherein the connector (140) further includes at least one reinforcing body (155) that extends between two or more pole-receiving regions (151).

A19. The tent (10) of any of paragraphs A15-A18, wherein the at least one clearance pole (130) includes an elastic cord (60) that extends within the at least one clearance pole (130), wherein the connector includes a clearance pole-receiving region (161) that receives the at least one clearance pole (130), and wherein the clearance pole-receiving region (161) includes an elastic cord receiver (186) that receives the elastic cord (60).

A19.1. The tent (10) of paragraph A19, wherein the tent (10) includes two clearance poles (130), wherein the at least one clearance pole (130) is a first clearance pole (130) and the tent (10) includes a second clearance pole (130), wherein the clearance pole-receiving region (161) is a first clearance pole-receiving region (161), and connector (140) includes a second clearance pole-receiving region (161) that receives the second clearance pole (130) and that includes an elastic cord receiver (186), wherein the elastic cord receivers (186) of the first clearance pole-receiving region (161) and the second clearance pole-receiving region (161) are interconnected, and wherein the elastic cord (60) further extends from the elastic cord receiver (186) of the first clearance pole-receiving region (161) through the elastic cord receiver (186) of the second clearance pole-receiving region (161) and to within the second clearance pole (130) to elastically interconnect the first clearance pole (130) and the second clearance pole (130).

A19.2. The tent (10) of any of paragraphs A15-A19.1, wherein the assembled tent frame (110) includes at least one frame pole (114), and wherein the at least one frame pole (114) includes an elastic cord (60) that extends within the at least one frame pole (114), wherein the plurality of pole-receiving regions (151) includes a frame pole-receiving region (160) that receives the at least one frame pole (114), wherein the frame pole-receiving region (160) includes an elastic cord receiver (186) that receives the elastic cord (60) that extends within the at least one frame pole (114).

A19.2.1. The tent (10) of paragraph A19.2, wherein the assembled tent frame (110) includes a plurality of frame poles (114), wherein the at least one frame pole (114) is a first frame pole (114) and the plurality of frame poles (114) includes a second frame pole (114), wherein the frame pole-receiving region (160) is a first frame pole-receiving region (160), and wherein the connector (140) includes a second frame pole-receiving region (160) that receives the second frame pole (114) and that includes an elastic cord receiver (186), wherein the elastic cord receivers (186) of the first frame pole-receiving region (160) and the second frame pole-receiving region (160) are interconnected, and wherein the elastic cord (60) further extends from the elastic cord receiver (186) of the first frame pole-receiving region (160) through the elastic cord receiver (186) of the second frame pole-receiving region (160) to within the second frame pole (114) to elastically interconnect the first frame pole (114) and the second frame pole (114).

A20. The tent (10) of any of paragraphs A1-A19.2.1, wherein the tent (10) includes a plurality of clearance poles (130).

A21. The tent (10) of paragraph A20, wherein when the plurality of clearance poles (130) are operatively coupled to the assembled tent frame (110), a/the tensioning structure (30) extends between a/the distal ends (34) of two or more clearance poles (130) of the plurality of clearance poles (130).

A21.1 The tent (10) of paragraph A21, wherein the tensioning structure (30) tensions at least the distal ends (34) of the two or more clearance poles (130) in the upward direction.

A21.2 The tent (10) of paragraph A21.2, wherein the two or more clearance poles form a tensioned pair or a tensioned network.

A22. The tent (10) of any of paragraphs A20-A21.2, wherein the plurality of clearance poles (130) includes a pair of clearance poles (132), wherein each clearance pole (130) of the pair of clearance poles (132) includes a proximal end (32) that is operatively coupled to the assembled tent frame (110) via the connector (140), and wherein the pair of clearance poles (132) extend from the connector (140) in opposing directions.

A23. The tent (10) of paragraph A22, wherein a/the tensioning structure (30) extends between a/the distal ends (34) of the pair of clearance poles (132).

A24. The tent (10) of any of paragraphs A22-A23, wherein the pair of clearance poles (132) form a clearance pair angle therebetween, wherein the clearance pair angle is at least 100° or at most 170°.

A24.1. The tent (10) of paragraph A24, wherein the clearance pair angle is at least 130° or at most 165°.

A25. The tent (10) of any of paragraphs A22-A24, wherein the assembled tent frame (110) includes at least one laterally extending section (40) that extends substantially parallel to the support surface (16), and wherein the connector (140) is configured to orient the pair of clearance poles (132) to project traverse to the at least one laterally extending section (40).

A26. The tent (10) of paragraph A25, wherein the pair of clearance poles (132) are operatively coupled to the at least one laterally extending section (40) of the assembled tent frame (110) via the connector (140).

A27. The tent (10) of any of paragraphs A22-A23, wherein the plurality of clearance poles (130) comprises an individual clearance pole (134), wherein the individual clearance pole (134) is operatively coupled to the connector (140), and wherein the individual clearance pole (134) extends from the connector (140) between the pair of clearance poles (132).

A28. The tent (10) of paragraph 27, wherein a/the tensioning structure (30) extends between the pair of clearance poles (132) and the individual clearance pole (134).

A29. The tent (10) of any of paragraphs A20-A28, wherein the clearance mechanism (20) includes a plurality of connectors (140), wherein the connector (140) is a first connector (140), and wherein the plurality of connectors (140) further includes at least a second connector (140).

A30. The tent (10) of paragraph A29, when depending from any of paragraphs A22-A28, wherein the pair of clearance poles (132) is a first pair of clearance poles (132), wherein the plurality of clearance poles (130) further includes a second pair of clearance poles (132), and wherein the first connector (140) is configured to operatively couple the first pair of clearance poles (132) to the assembled tent frame (110), and the second connector (140) is configured to operatively couple the second pair of clearance poles (132) to the assembled tent frame (110).

A31. The tent (10) of paragraph A29, wherein the plurality of clearance poles (130) comprises a first clearance pole (130) and a second clearance pole (130), wherein the connector (140) is configured to operatively couple the first clearance pole (130) to the assembled tent frame (110) and the second connector (140) is configured to operatively couple the second clearance pole (130) to the assembled tent frame (110).

A31.1 The tent of paragraph A31, wherein the first clearance pole (130) and the second clearance pole (130) are individual clearance poles (134).

A32. The tent (10) of any of paragraphs A31-A31.1, wherein the first connector (140) and the second connector (140) are configured to orient the first clearance pole (130) and the second clearance pole (130) to extend in opposing directions relative to one another.

A33. The tent (10) of any of paragraphs A31-A32, wherein a/the tensioning structure (30) extends between a/the distal end (34) of the first clearance pole (130) and a/the distal end (34) of the second clearance pole (130) when the first clearance pole (130) and the second clearance pole (130) are operatively coupled to the assembled tent frame (110).

A34. The tent (10) of any of paragraphs A29-A33, wherein the plurality of connectors (140) further comprises a third connector (140) and a fourth connector (140), wherein the plurality of clearance poles (130) comprises a third clearance pole (130) and a fourth clearance pole (130), and wherein the third connector (140) is configured to operatively couple the third clearance pole (130) to the assembled tent frame (110), and the fourth connector (140) is configured to operatively couple the fourth clearance pole (130) to the assembled tent frame (110).

A34.1. The tent (10) of paragraph A34, wherein the third connector (140) and the fourth connector (140) are configured orient the third clearance pole (130) and the fourth clearance pole (130) to extend in opposing directions relative to one another.

A34.2 the tent (10) of any of paragraphs A34-A34.1, wherein the third clearance pole (130) and the fourth clearance pole (130) are individual clearance poles (134).

A35. The tent (10) of paragraph A29, when depending from any of paragraphs A22-A28, wherein the plurality of connectors (140) further includes a third connector (140), wherein the plurality of clearance poles (130) comprises a first clearance pole (130) and a second clearance pole (130), and wherein the second connector (140) is configured to operatively couple the first clearance pole (130) to the assembled tent frame (110) and the third connector (140) is configured to operatively couple the second clearance pole (130) to the assembled tent frame (110).

A35.1 The tent of paragraph A35, wherein the second clearance pole (130) and the third clearance pole (130) are individual clearance poles.

A36. The tent (10) of any of paragraphs A1-A35.1, wherein the assembled tent frame (110) includes a support frame (42) having a pair of ends that operatively contact the support surface (16).

A37. The tent (10) of paragraph A36, wherein the support frame (42) includes a/the laterally extending section (40) and a pair of upwardly extending sections (44).

A38. The tent (10) of paragraph A37, when depending from any of paragraphs A29-A35.1, wherein the first connector (140) and the second connector (140) are operatively coupled to either upwardly extending section (44) of the pair of upwardly extending sections (44).

A39. The tent (10) of any of paragraphs A36-A38, wherein the support frame (42) includes a single frame pole (114).

A39.1 The tent (10) of any of paragraphs A36-A39, wherein the support frame (42) includes a unit pole (311).

A40. The tent (10) of any of paragraphs A36-A38, wherein the support frame (42) includes a pair of leg poles (112), which each have one end that operatively contacts the support surface (16), and a roof pole (111) that extends between the pair of leg poles (112), wherein the roof pole (111) includes a pair of ends, and each end of roof pole (111) is operatively coupled to an upper end of a leg pole (112) of the pair of leg poles (112).

A41. The tent (10) of paragraph A40, when depending from any of paragraphs A29-A34.2, wherein the first connector (140) and the second connector (140) are operatively coupled to either end of the roof pole (111), and wherein the first connector (140) and the second connector (140) operatively couple the roof pole (111) to the pair of leg poles (112).

A41.1 The tent (10) of paragraph A40, when depending from any of paragraphs A35-A35.1, wherein the second connector (140) and the third connector (140) are operatively coupled to either end of the roof pole (111), and wherein the first connector (140) is operatively coupled to a/the laterally extending section of the roof pole (111).

A42. The tent (10) of any of paragraphs A39-A41, wherein the assembled tent frame (110) comprises a plurality of support frames (42), wherein the support frame (42) is a first support frame (42), and wherein the plurality of support frames (42) further includes a second support frame (42).

A43. The tent (10) of paragraphs A42, wherein the second support frame (42) includes a/the laterally extending section (40) and a pair of upwardly extending sections (44).

A44. The tent (10) of any of paragraphs A42-A43, wherein the first support frame (42) and the second support frame (42) cross over one another proximate an apex (70) of the assembled tent frame (110).

A45. The tent (10) of paragraph A44, wherein the apex (70) comprises a/the laterally extending section (40).

A46. The tent (10) of paragraph A43, wherein the first support frame (42) and the second support frame (42) cross over one another along a/the upwardly extending sections (44) of the first support frame (42) and the second support frame (42).

A47. The tent (10) of any of paragraphs A42-A46, when depending from any of paragraphs A34-A34.1, wherein the third connector (140) and the fourth connector (140) are operatively coupled to either upwardly extending section (44) of a/the pair of upwardly extending sections (44) of the second support frame (42).

A48. The tent (10) of any of paragraphs A42-A47, wherein the second support frame (42) includes a single frame pole (114).

A48.1. The tent (10) of any of paragraphs A42-A48, wherein the second support frame (42) includes a unit pole (311).

A49. The tent (10) of any of paragraphs A42-A47, wherein the second support frame (42) includes a pair of leg poles (112), which each have one end that operatively contacts the support surface (16) and a roof pole (111) that extends between the pair of leg poles (112), wherein the roof pole (111) includes a pair of ends and each end of roof pole (111) is operatively coupled to an upper end of a leg pole (112) of the pair of leg poles (111).

A50. The tent (10) of paragraph A49, when depending from any of paragraphs A34-A35.1, wherein the third connector (140) and the fourth connector (140) are operatively coupled to either end of the roof pole (111) of the second support frame (42), and wherein the third connector (140) and the fourth connector (140) operatively couple the pair of leg poles (112) to the roof pole (111) of the second support frame (42).

A51. The tent (10) of paragraph A36, wherein the assembled tent frame (110) further comprises at least one leg pole (112) having at least one end that operatively contacts the support surface (16) and a roof pole (111) that extends between the support frame (42) and the at least one leg pole (112).

A51.1 The tent (10) of paragraph A51, wherein the roof pole (111) includes a/the laterally extending section (40).

A52. The tent (10) of any of paragraphs A51-A51.1, wherein the assembled tent frame (110) comprises a plurality of support frames (42), wherein the support frame (42) is a first support frame (42), wherein the plurality of support frames (42) further includes a second support frame (42), and wherein the second support frame includes the at least one leg pole (112).

A52.1. The tent (10) of any of paragraphs A51-A52, when depending from any of paragraphs A35-A35.1, wherein the first connector (140) operatively couples a/the pair of clearance poles (132) to the roof pole (111), and wherein the second connector (140) operatively couples the first clearance pole (130) to the first support frame (42) and the roof pole (111), and wherein the third connector (140) operatively couples the second clearance pole (130) to the at least one leg pole (112) and the roof pole (111).

A52.2. The tent (10) of paragraph A52.1, wherein the second connector (140) and the third connector (140) orient the first clearance pole (130) and the second clearance pole (130) to extend in opposing directions relative to one another.

A53. The tent (10) of any of paragraphs A51-A52, when depending from any of paragraphs A22-A28, wherein the connector (140) operatively couples the pair of clearance poles (132) to the roof pole (111).

A54. The tent (10) of any of paragraphs A51-A52, when depending from any of paragraphs A30-A34.2, wherein the first connector (140) is operatively coupled to the support frame (42) and one end of the roof pole (111), and wherein the first connector (140) interconnects the one end of the roof pole (111) with the support frame (42), and wherein the second connector (140) is operatively coupled to the at least one leg pole (112) and the other end of the roof pole (111), and wherein the second connector (140) interconnects the other end of the roof pole (111) and the at least one leg pole (112).

A55. The tent (10) of any of paragraphs A1-A54, wherein the assembled tent frame (110) comprises a plurality of interconnected frame poles (114).

A56. The tent (10) of paragraph A55, wherein the plurality of interconnected frame poles (114) are interconnected via at least one of one or more connectors (140) and one or more frame pole connectors (141).

A57. The tent (10) of any of paragraphs A55-A56, wherein at least one frame pole (114) of the plurality of interconnected frame poles (114) is a segmented frame pole and includes a plurality of pole segments (118) that are configured to be interconnected to form the at least one frame pole (114).

A58. The tent (10) of paragraph A57, wherein the segmented frame pole further includes an elastic cord (60) that extends within the segmented frame pole and interconnects the plurality of pole segments (118).

A59. The tent (10) of any of paragraphs A55-A58, wherein two or more frame poles (114) of the plurality of interconnected frame poles (114) include an elastic cord (60), wherein the elastic cord (60) extends within each frame pole (114) of the two or more frame poles (114), and wherein the elastic cord (60) extends between the two or more frame poles (114).

A60. The tent (10) of paragraph A59, wherein the two or more frame poles (114) are interconnected via one of the connector (140) and a frame pole connector (141), and wherein the elastic cord (60) extends through one of the connector (140) and the frame pole connector (141).

A61. The tent (10) of any of paragraphs A1-A60, wherein the at least one clearance pole (130) includes an elastic cord (60), and wherein the elastic cord (60) extends between the at least one clearance pole (130) and the connector (140).

A61.1 The tent (10) of any of paragraphs A55-A61, wherein each frame pole (114) of the plurality of interconnected frame poles (114) and the at least one clearance pole (130) are interconnected via one or more elastic cords (60).

A62. The tent (10) of any of paragraphs A1-A61.1, wherein the tent (10) is configured to be selectively and repeatedly assembled from a disassembled state to an assembled state (18) and disassembled from the assembled state (18) to the disassembled state without damage to the tent frame (100), the at least one clearance pole (130), and the clearance mechanism (20).

A63. The tent (10) of paragraph A62, wherein the at least one clearance pole (130) is configured to be at least disengaged from the tent frame (100) and the clearance mechanism (20) when the tent is in the disassembled state.

A64. The tent (10) of any of paragraphs A62-A63, wherein the tent includes a plurality of interconnecting sections, wherein each section of the plurality of interconnecting sections is interconnected to one or more other sections of the plurality of interconnecting sections when the tent is in the assembled state, and wherein each section is configured to be disengaged from the one or more other sections to disassemble the tent.

A64.1 The tent (10) of paragraph A64, wherein the plurality of interconnecting sections are elastically interconnected by one or more elastic cords when the tent is disassembled.

A65. The tent (10) of any of paragraphs A64-A64.1, wherein the plurality of interconnecting sections includes at least one connector (140).

A66. The tent (10) of any of paragraphs A64-A65, wherein the plurality of interconnecting sections includes a/the plurality of interconnected frame poles (114).

A67. The tent (10) of any of paragraphs A64-A66, when depending from any of paragraphs A57-A58, wherein the plurality of interconnecting sections includes the plurality of pole segments (118).

A67.1 The tent (10) of any of paragraphs A64-A66, wherein the plurality of interconnecting sections includes a/the at least one frame pole (114).

A68. The tent (10) of any of paragraphs A64-A67, wherein the plurality of interconnecting sections includes a/the inner tent fabric (122).

A69. The tent (10) of any of paragraphs A64-A68, wherein the plurality of interconnecting section includes a/the outer tent fabric (120).

A70. The tent (10) of any of paragraphs A64-A69, wherein the plurality of interconnecting sections are configured to be stowed in a condensed state.

A71. The tent (10) of any of paragraphs A64-A70, further including a stowage bag that is configured to receive and surround the plurality of interconnecting sections in a/the condensed state.

A72. The tent (10) of any of paragraphs A64-A71, wherein the plurality of interconnecting sections define a kit for forming an assembled tent when the plurality of interconnected sections are in the disassembled state.

A73. An assembled tent according to any of paragraphs A1-A72.

A74. A disassembled tent according to any of paragraphs A1-A73.

The present disclosure may be embodied in any other specific form without departing from the spirit and essential feature of the present disclosure. Therefore, it should be noted that the detailed description is for illustration only, but not intended to be limiting in all aspects. The scope of the present disclosure should be determined by the reasonable interpretation of the appended claims, and the scope of the present disclosure covers all modifications made within the equivalent scope of the present disclosure.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a tent according to the present disclosure, means that the specified action, movement, configuration, or other activity is a direct or indirect result of user manipulation of an aspect of, or one or more components of, the tent.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

The invention claimed is:

1. A tent (10), comprising:

a tent frame (100) that, when assembled, forms an assembled tent frame (110) that is configured to support the tent (10) on a support surface (16) and define an inner space (12) between the assembled tent frame (110) and the support surface (16);

at least one clearance pole (130) that, when operatively coupled to the assembled tent frame (110), extends away from the inner space (12) to define an outer space (14); and a clearance mechanism (20) that is configured to operatively couple the at least one clearance pole (130) to the assembled tent frame (110) and orient the at least one clearance pole (130) to project in an upward direction at a clearance angle in the range of 2 degrees to 80 degrees relative to the support surface (16), wherein the clearance mechanism (20) includes a connector (140) that is configured to operatively couple the at least one clearance pole (130) to the tent frame (100);

wherein the tent (10) includes a plurality of clearance poles (130), wherein the plurality of clearance poles (130) includes a pair of clearance poles (132), wherein each clearance pole (130) of the pair of clearance poles (132) includes a proximal end (32) that is operatively coupled to the assembled tent frame (110) via the connector (140), wherein the pair of clearance poles (132) extend from the connector (140) in opposing directions, wherein the assembled tent frame (110) includes a support frame (42) having a pair of ends that operatively contact the support surface (16), wherein the assembled tent frame (110) further includes at least one leg pole (112) having at least one end that operatively contacts the support surface (16) and a roof pole (111) that extends between the support frame (42) and the at least one leg pole (112), and wherein the connector (140) is configured to operatively couple the pair of clearance poles (132) to the roof pole (111).

2. The tent (10) of claim 1, wherein the clearance mechanism (20) is configured to orient at least a distal end (34) of the at least one clearance pole (130) to project in the upward direction.

3. The tent (10) of claim 1, wherein the clearance mechanism (20) is configured to orient the entirety of the at least one clearance pole (130) to extend in the upward direction.

4. The tent (10) of claim 1, wherein the connector (140) is configured to operatively couple to the proximal end (32) of the at least one clearance pole (130), and wherein the connector (140) is configured to orient the proximal end (32) of the at least one clearance pole (130) to extend in the upward direction when the connector (140) operatively couples the at least one clearance pole (130) to the assembled tent frame (110).

5. The tent (10) of claim 1, wherein the clearance mechanism (20) includes a tensioning structure (30) that operatively couples to at least a distal end (34) of the at least one clearance pole (130) and at least one other portion of the tent (10), and wherein the tensioning structure (30) is configured to tension at least the distal end (34) of the at least one clearance pole (130) in the upward direction when the at least one clearance pole (130) is operatively coupled to the assembled tent frame (110).

6. The tent (10) of claim 1, further comprising an inner tent fabric (122) that is configured to be operatively coupled to the assembled tent frame (110) and surround at least a portion of the inner space (12), wherein the inner tent fabric (122) further is configured to be coupled to the at least one clearance pole (130), and wherein the at least one clearance pole (130) is configured to support a portion of the inner tent fabric (122) when the at least one clearance pole (130) is operatively coupled to the assembled tent frame (110).

7. The tent (10) of claim 1, further comprising an outer tent fabric (120), wherein the at least one clearance pole (130) is configured to operatively support the outer tent fabric (120) when the at least one clearance pole (130) is operatively coupled to the assembled tent frame (110), and wherein the outer tent fabric (120) surrounds at least a portion of the outer space (14) when supported by the at least one clearance pole (130).

8. The tent (10) of claim 7, wherein the outer tent fabric (120) is configured to surround at least a portion of the assembled tent frame (110), and wherein when the at least one clearance pole (130) is coupled to the assembled tent frame (110), the at least one clearance pole (130) is configured to support the outer tent fabric (120) spaced above at least a portion of the assembled tent frame (110) that is proximate to a location that the at least one clearance pole (130) is coupled to the assembled tent frame (110).

9. The tent (10) of claim 7, wherein the clearance mechanism (20) includes a tensioning structure (30) that operatively couples to at least a distal end (34) of the at least one clearance pole (130) and at least one other portion of the tent (10), and wherein the tensioning structure (30) is configured to tension at least the distal end (34) of the at least one clearance pole (130) in the upward direction when the at least one clearance pole (130) is operatively coupled to the assembled tent frame (110), and wherein the outer tent fabric (120) includes the tensioning structure (30).

10. The tent (10) of claim 7, wherein the tent (10) includes an inner tent fabric (122) that is configured to be operatively coupled to the assembled tent frame (110) and surround at least a portion of the inner space (12), wherein the at least one clearance pole (130) is configured to support at least a portion of the outer tent fabric (120) spaced apart from the inner tent fabric (122) to form a clearance volume (22) therebetween.

11. The tent (10) of claim 1, wherein when the plurality of clearance poles (130) are operatively coupled to the assembled tent frame (110), a tensioning structure (30) extends between distal ends (34) of two or more clearance poles (130) of the plurality of clearance poles (130) and tensions at least the distal ends (34) of the two or more clearance poles (130) in the upward direction.

12. The tent (10) of claim 1, wherein the pair of clearance poles (132) form a clearance pair angle therebetween, wherein the clearance pair angle is at least 130° or at most 165°.

13. The tent (10) of claim 1, wherein the assembled tent frame (110) includes at least one laterally extending section (40) that extends substantially parallel to the support surface (16), and wherein the connector (140) is configured to orient the pair of clearance poles (132) to project transverse to the at least one laterally extending section (40).

14. The tent (10) of claim 1, wherein the connector (140) is configured to orient the pair of clearance poles (132) to extend transverse to the roof pole (111).

15. The tent (10) of claim 1, wherein the assembled tent frame (110) comprises a plurality of support frames (42), wherein the support frame (42) is a first support frame (42), wherein the plurality of support frames (42) further includes a second support frame (42), and wherein the second support frame (42) includes the at least one leg pole (112).

16. The tent (10) of claim 15, wherein the clearance mechanism (20) includes a plurality of connectors (140), wherein the connector (140) is a first connector (140) and the plurality of connectors (140) further includes a second connector (140) and a third connector (140), wherein the plurality of clearance poles (130) includes a first individual clearance pole (134) and a second individual clearance pole (134), wherein the second connector (140) operatively couples the first individual clearance pole (134) to the first support frame (42) and the roof pole (111), wherein the third connector (140) operatively couples the second individual clearance pole (134) to the second support frame (42) and the roof pole (111).

17. The tent (10) of claim 16, wherein the second connector (140) and the third connector (140) are configured to orient the first individual clearance pole (134) and the second individual clearance pole (134) to extend in opposing directions relative to one another.

18. The tent (10) of claim 1, wherein the assembled tent frame (110) comprises a plurality of interconnected frame poles (114), and wherein the plurality of interconnected frame poles (114) are interconnected via the connector (140) and one or more frame pole connectors (141).

19. The tent (10) of claim 1, wherein the tent (10) has an assembled state (18) and a disassembled state, wherein the tent (10) is configured to be selectively and repeatedly assembled from the disassembled state to the assembled state (18) and disassembled from the assembled state (18) to the disassembled state without damage to the tent frame (100), the at least one clearance pole (130), and the clearance mechanism (20).

20. The tent (10) of claim 19 in one of the assembled state (18) and the disassembled state.

21. A tent (10), comprising:

a tent frame (100) that, when assembled, forms an assembled tent frame (110) that is configured to support the tent (10) on a support surface (16) and define an inner space (12) between the assembled tent frame (110) and the support surface (16);

a pair of clearance poles (132) that, when operatively coupled to the assembled tent frame (110), extends away from the inner space (12) to define an outer space (14); and a clearance mechanism (20) that is configured to operatively couple the pair of clearance poles (132) to the assembled tent frame (110) and orient each clearance pole (130) of the pair of clearance poles (132) to project in an upward direction at a clearance angle in the range of 2 degrees to 80 degrees relative to the support surface (16), wherein the clearance mechanism (20) includes a connector (140) that is configured to operatively couple a proximal end (32) of each clearance pole (130) of the pair of clearance poles (132) to the tent frame (100) and to orient the pair of clearance poles (132) to extend in opposing directions from the connector (140);

wherein the proximal end (32) of each clearance pole (130) of the pair of clearance polies (132) is operatively coupled to the assembled tent frame (110) via the connector (140), wherein the pair of clearance poles (132) extend from the connector (140) in opposing directions, wherein the assembled tent frame (110) includes a support frame (42) having a pair of ends that operatively contact the support surface (16), wherein the assembled tent frame (110) further includes at least one leg pole (112) having at least one end that operatively contacts the support surface (16) and a roof pole (111) that extends between the support frame (42) and the at least one leg pole (112), and wherein the connector (140) is configured to operatively couple the pair of clearance poles (132) to the roof pole (111).

22. The tent of claim 21, wherein each clearance pole (130) of the pair of clearance poles (132) includes a distal end (34) that is opposed to the proximal end (32) thereof, wherein the tent (10) further comprises an outer tent fabric (120), wherein when the pair of clearance poles (132) are operatively coupled to the assembled tent frame (110):

the outer tent fabric (120) is configured to couple to the distal end (34) of each clearance pole (130) of the pair of clearance poles (132) and tension the pair of clearance poles (132) in the upward direction against one another; and the distal end (34) of each clearance pole (130) of the pair of clearance poles (132) is configured to apply an outward force to the outer tent fabric (120) that tensions the outer tent fabric (120) to form a ridge between the pair of clearance poles (132).

23. The tent (10) of claim 21, wherein when the pair of clearance poles (132) are operatively coupled to the assembled tent frame (110), a tensioning structure (30) extends between the distal ends (34) of each clearance pole (130) of the pair of clearance poles (132) and tensions at least the distal ends (34) of each clearance pole (130) of the pair of clearance poles (132) in the upward direction.

24. The tent (10) of claim 21, wherein the pair of clearance poles (132) form a clearance pair angle therebetween, wherein the clearance pair angle is at least 130 degrees or at most 165 degrees.

25. The tent (10) of claim 21, wherein the assembled tent frame (110) includes at least one laterally extending section (40) that extends substantially parallel to the support surface (16), and wherein the connector (140) is configured to orient the pair of clearance poles (132) to project transverse to the at least one laterally extending section (40).

* * * * *